US006520139B2

(12) United States Patent
Kobayashi

(10) Patent No.: US 6,520,139 B2
(45) Date of Patent: Feb. 18, 2003

(54) TIMING CHAIN LUBRICATING STRUCTURE FOR ENGINE

(75) Inventor: Toshiki Kobayashi, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/953,619

(22) Filed: Sep. 17, 2001

(65) Prior Publication Data

US 2002/0035983 A1 Mar. 28, 2002

(30) Foreign Application Priority Data

Sep. 18, 2000 (JP) ..... 2000-281524

(51) Int. Cl.[7] ..... F01M 1/08; F01L 1/02
(52) U.S. Cl. ..... 123/196 R; 123/90.31
(58) Field of Search ..... 123/90.33, 90.34, 123/196 R, 196 M, 195 C, 90.31; 184/15.1, 15.2, 15.3

(56) References Cited

U.S. PATENT DOCUMENTS 4,974,561 A 12/1990 Murasaki et al. ..... 123/90.31
5,743,228 A * 4/1998 Takahashi ..... 123/195 P
6,076,492 A * 6/2000 Takahashi ..... 123/90.17
6,332,441 B1 * 12/2001 Sugiyama et al. ..... 123/90.31

FOREIGN PATENT DOCUMENTS

| | | |
|---|---|---|
| JP | 6-146838 | 5/1994 |
| JP | 6-146839 | 5/1994 |
| JP | 2000-227014 | 8/2000 |

OTHER PUBLICATIONS

Copy of European Patent Office Search Report for corresponding European Patent Application 01 12 2294 dated Aug. 6, 2002.

* cited by examiner

*Primary Examiner*—Willis R. Wolfe
(74) *Attorney, Agent, or Firm*—Armstrong, Westerman & Hattori, LLP

(57) ABSTRACT

Sprockets are fixed to ends of camshafts supported in a cylinder head via camshaft holders. A timing chain is wrapped around these sprockets. The relief oil from a hydraulic control value for controlling a variable valve operating characteristic mechanism passes through an oil passage formed in the plane in which the cylinder head and the camshaft holder are joined and flows out of an oil drain hole, thus lubricating the section where the sprocket is meshed with the timing chain. The section where the sprocket of the camshaft is meshed with the timing chain can thereby be lubricated reliably by a simple structure.

20 Claims, 14 Drawing Sheets

TIMING CHAIN LUBRICATING STRUCTURE FOR ENGINE

BACKGROUND OF THE INVENTION

1. Field of the Invention

The present invention relates to an engine in which a sprocket is fixed to one end of a camshaft supported in a cylinder head via a camshaft holder and a timing chain is wrapped around the sprocket and, in particular, to a timing chain lubricating structure therefor.

2. Description of the Related Art

A camshaft of an overhead camshaft type engine is driven by an arrangement in which a sprocket fixed to a shaft end of the camshaft is linked to a sprocket fixed to a shaft end of a crankshaft via a timing chain. A lubricating structure for such a timing chain is known in Japanese Patent Application Laid-open No. 6-146838. The timing chain lubrication structure disclosed in the above-mentioned application has an arrangement in which a relief valve is provided in an oil passage for supplying oil to a hydraulic tappet, and the section where the sprocket is meshed with the chain is lubricated with a jet of oil that issues from an oil jet that is integral with the relief valve.

The above-mentioned conventional arrangement has a problem in that an oil jet is required thus increasing the number of parts, which is a main factor for an increase in the cost, and because the oil jet is formed integrally with the relief valve if the oil jet is placed in a position that is suitable for lubricating the section where the sprocket is meshed with the chain the degree of freedom with which the relief valve can be mounted would be limited.

SUMMARY OF THE INVENTION

The present invention has been carried out in view of the above-mentioned circumstances, and it is an object of the present invention to enable the section where a camshaft sprocket is meshed with a timing chain to be reliably lubricated by a simple structure.

In order to achieve the above-mentioned object, in accordance with a first aspect of the present invention, there is proposed a timing chain lubricating structure for an engine in which a sprocket is fixed to an end of a camshaft supported in a cylinder head via a camshaft holder and a timing chain is wrapped around the sprocket wherein a relief oil passage is formed in the plane of a joined surface of the camshaft holder, and an oil drain hole provided at the downstream end of the relief oil passage opens so as to face the section where the sprocket is meshed with the timing chain or the timing chain prior to the meshed section.

In accordance with the above-mentioned arrangement, because the sprocket and the timing chain are lubricated with oil that flows out of the oil drain hole provided at the downstream end of the relief oil passage, it becomes unnecessary to employ an oil jet, thus reducing the number of parts. Moreover, because the relief oil passage is formed in the plane of the joined surface of the camshaft holder, the relief oil passage can easily be formed.

Furthermore, in accordance with a second aspect of the present invention, in addition to the above-mentioned first aspect, there is proposed a timing chain lubricating structure for an engine wherein a hydraulic control valve for discharging oil to the relief oil passage is mounted on a cylinder head side wall that is close to the oil drain hole.

In accordance with the above-mentioned arrangement, because the hydraulic control valve for discharging oil to the relief oil passage is mounted on the side wall of the cylinder head, not only can the rigidity with which the hydraulic control valve is mounted be enhanced, but also the length of the relief oil passage can be reduced because the hydraulic control valve is mounted in a position close to the oil drain hole.

Furthermore, in accordance with a third aspect or a ninth aspect of the present invention, in addition to either the above-mentioned first aspect or second aspect, there is proposed a timing chain lubricating structure for an engine wherein a timing chain is wrapped around sprockets that are fixed to ends of an intake camshaft and an exhaust camshaft respectively, a chain guide for guiding the timing chain is fixed to cam caps of the two camshafts, the cam cap of the intake camshaft and the cam cap of the exhaust camshaft is linked integrally to each other via a connecting wall so as to form a camshaft holder, and a recess is formed in the face of the connecting wall opposite the chain guide.

In accordance with the above-mentioned arrangement, because the cam cap of the intake camshaft and the cam cap of the exhaust camshaft are linked integrally to each other via the connecting wall so as to form the camshaft holder and the chain guide is fixed so as to bridge the recess formed between the two cam caps and the connecting wall, the rigidity can be enhanced by connecting the two cam caps via the connecting wall and the chain guide while reducing the weight of the camshaft holder by means of the recess, and the rigidity with which the intake camshaft and the exhaust camshaft are supported can thus be enhanced.

Furthermore in accordance with a fourth aspect of the present invention, in addition to the above mentioned third aspect, there is proposed a timing chain lubricating structure for an engine wherein the camshaft holder is fastened to the cylinder head by means of outer bolts placed outside the intake camshaft and the exhaust camshaft, the camshaft holder and the chain guide are together fastened to the cylinder head by means of inner bolts placed inside the intake camshaft and the exhaust camshaft, and the seats of the outer bolts are formed so as to be lower than the seats of the inner bolts.

In accordance with the above-mentioned arrangement, because the camshaft holder and the chain guide are together fastened to the cylinder head by means of the common inner bolts, the number of bolts can be reduced. Moreover, because the seats of the outer bolts placed outside the two camshafts are formed so as to be lower than the seats of the inner bolts placed inside the two camshafts, the dimensions of the camshaft holder can be reduced and the dimensions of the engine can be reduced accordingly.

Furthermore, in accordance with a fifth aspect or a sixth aspect of the present invention, in addition to the above-mentioned third aspect or fourth aspect, there is proposed a timing chain lubricating structure for an engine wherein a tooth skipping prevention plate is formed integrally with the chain guide.

In accordance with the above-mentioned arrangement, because the tooth skipping prevention plate if formed integrally with the chain guide, the rigidity of the chain guide can be enhanced by the presence of the tooth skipping prevention plate.

Furthermore, in accordance with a seventh aspect or an eighth aspect of the present invention, in addition to the above-mentioned third aspect or fourth aspect, there is proposed a timing chain lubricating structure for an engine wherein the chain guide has a sliding member made of a resin, the sliding member being in sliding contact with the timing chain.

In accordance with the above-mentioned arrangement, because the resin-made sliding member in sliding contact with the timing chain is provided on the chain guide, not only can wear of the timing chain be suppressed, but also the sliding resistance between the chain guide and the timing chain can be reduced.

Furthermore, in accordance with a tenth aspect of the present invention, in addition to the above-mentioned first aspect, there is proposed a timing chain lubricating structure for an engine wherein the camshaft holder comprises an upper camshaft holder and a lower camshaft holder and the oil drain hole is formed in the lower camshaft holder close to the meshed section.

In accordance with the above-mentioned arrangement, because the camshaft holder comprises the upper camshaft holder and the lower camshaft holder and the oil drain hole if formed in the lower camshaft holder close to the meshed section, it is possible to prevent the oil passage from becoming complicated.

Furthermore, in accordance with an eleventh aspect of the present invention, in addition to the above-mentioned tenth aspect, there is proposed a timing chain lubricating structure for an engine wherein a rocker arm shaft provided beneath the camshaft is supported in the lower camshaft holder and the oil drain hole is provided in the plane in which the lower camshaft holder and the cylinder head are joined together.

In accordance with the above-mentioned arrangement, because the rocker arm shaft provided beneath the camshaft is supported in the lower camshaft holder and the oil drain hole is provided in the plane in which the lower camshaft holder and the cylinder head are joined together, the oil drain hole can be formed by making use of a thick part of the lower camshaft holder that functions as a rocker arm shaft holder.

Furthermore, in accordance with a twelfth aspect of the present invention, in addition to the above-mentioned eleventh aspect, there is proposed a timing chain lubricating structure for an engine wherein the oil drain hole and the rocker arm shaft are provided on either side of the camshaft so that the camshaft is interposed therebetween.

In accordance with the above-mentioned arrangement, because the oil drain hole and the rocker arm shaft are provided on either side of the camshaft so that the camshaft is interposed therebetween, the oil drain hole is provided effectively using a space opposite to the rocker arm shaft thus preventing any increase in the dimensions of the lower camshaft holder.

Furthermore, in accordance with a thirteenth aspect or a fourteenth aspect of the present invention, in addition to either the above-mentioned second aspect or twelfth aspect, there is proposed a timing chain lubricating structure for an engine wherein the oil drain hole is provided closer to the hydraulic control valve than to the axis of the camshaft that is placed on the hydraulic control valve side.

In accordance with the above-mentioned arrangement, because the oil drain hole is provided closer to the hydraulic control valve than to the axis of the camshaft that is placed on the hydraulic control valve side, the length of the oil passage can be further reduced.

Furthermore, in accordance with a fifteenth aspect of the present invention, in addition to the above-mentioned first aspect, there is proposed a timing chain lubricating structure for an engine wherein the relief oil passage is provided along a camshaft holder fastening bolt for fastening the camshaft holder.

In accordance with the above-mentioned arrangement, because the relief oil passage is provided along the camshaft holder fastening bolt for fastening the camshaft holder, leakage of oil from the joined surfaces can be prevented.

Furthermore, in accordance with a sixteenth aspect of the present invention, in addition to the above-mentioned first aspect, there is proposed a timing chain lubricating structure for an engine wherein the camshaft holder is fastened by camshaft holder fastening bolts provided on either side of the camshaft axis and one of the camshaft holder fastening bolts that is closer to the relief oil passage is shorter than the other camshaft holder fastening bolt.

In accordance with the above-mentioned arrangement, because the camshaft holder is fastened by the camshaft holder fastening bolts provided on either side of the camshaft axis and the one of the camshaft holder fastening bolts that is closer to the relief oil passage is shorter than the other camshaft holder fastening bolt, the force with which the camshaft holder is fastened can be increased thus suppressing leakage of oil from the joined surfaces.

Furthermore, in accordance with a seventeenth aspect of the present invention, in addition to the above-mentioned fourth aspect, there is proposed a timing chain lubricating structure for an engine wherein the relief oil passage is provided closer to an outer bolt than to an inner bolt.

In accordance with the above-mentioned arrangement, because the relief oil passage is provided closer to the outer bolt than to the inner bolt, the force with which the camshaft holder is fastened can be increased thus suppressing leakage of oil from the joined surfaces.

Furthermore, in accordance with an eighteenth aspect of the present invention, in addition to the above-mentioned first aspect, there is proposed a timing chain lubricating structure for an engine wherein the relief oil passage is provided between a camshaft holder fastening bolt for fastening the camshaft holder and the sprocket.

In accordance with the above-mentioned arrangement, because the relief oil passage is provided between the camshaft holder fastening bolt for fastening the camshaft holder and the sprocket, the oil drain hole can be made closer to the section that is to be lubricated thus enhancing the lubrication efficiency.

Furthermore, in accordance with a nineteenth aspect of the present invention, in addition to the above-mentioned eighteenth aspect, there is proposed a timing chain lubricating structure for an engine wherein the relief oil passage is provided along the camshaft holder fastening bolt.

In accordance with the above-mentioned arrangement, because the relief oil passage if provided along the camshaft holder fastening bolt, it is possible to suppress leakage of oil from the joined surface of the camshaft holder.

Furthermore, in accordance with a twentieth aspect of the present invention, in addition to the above-mentioned first aspect, there is proposed a timing chain lubricating structure for an engine wherein the oil drain hole is provided on the side of the sprocket that is close to a hydraulic control valve that discharges oil to the relief oil passage.

In accordance with the above-mentioned arrangement, because the oil drain hole is provided on the side of the sprocket that is close to the hydraulic control valve that discharges oil to the relief oil passage, the oil passage can be shortened.

An exhaust camshaft 13 of the embodiments corresponds to the camshaft of the present invention, an intake camshaft sprocket 15 and an exhaust camshaft sprocket 16 of the embodiments correspond to the sprockets of the present invention, a lower camshaft holder 25 of the embodiments corresponds to the camshaft holder of the present invention, bolts 28 and 29 of the embodiments correspond to the inner bolts of the present invention, bolts 27 and 30 of the embodiments correspond to the outer bolts of the present invention, a first hydraulic control value 34 of the embodiments corresponds to the hydraulic control value of the present invention, and an oil passage P7 of the embodiments corresponds to the relief oil passage of the present invention.

The above-mentioned objects, other objects, characteristics and advantages of the present invention will become apparent from explanation of preferred embodiments that will be described in detail below by reference to the attached drawings.

BRIEF DESCRIPTION OF THE DRAWINGS

FIG. 1 is a perspective view of an engine.

FIG. 2 is a magnified view from arrow 2 in FIG. 1.

FIG. 3 is a magnified view from arrow 3 in FIG. 1.

FIG. 4 is a cross section at line 4—4 in FIG. 3.

FIG. 5 is a magnified view of an essential part of FIG. 4.

FIG. 6 is a diagram for explaining the action corresponding to FIG. 5.

FIG. 7 is a view from line 7—7 in FIG. 3.

FIG. 8 is a magnified cross section at line 8—8 in FIG. 3.

FIG. 9 is a magnified cross section of an essential part of FIG. 3.

FIG. 10 is a magnified cross section at line 10—10 in FIG. 2.

FIG. 11 is a cross section at line 11—11 in FIG. 3

FIG. 12 is a cross section at line 12—12 in FIG. 11.

FIG. 13 is a diagram for explaining a state in which a measurement apparatus is used.

DESCRIPTION OF PREFERRED EMBODIMENTS

A first embodiment of the present invention is explained below by reference to FIGS. 1 to 13.

Figure 1:
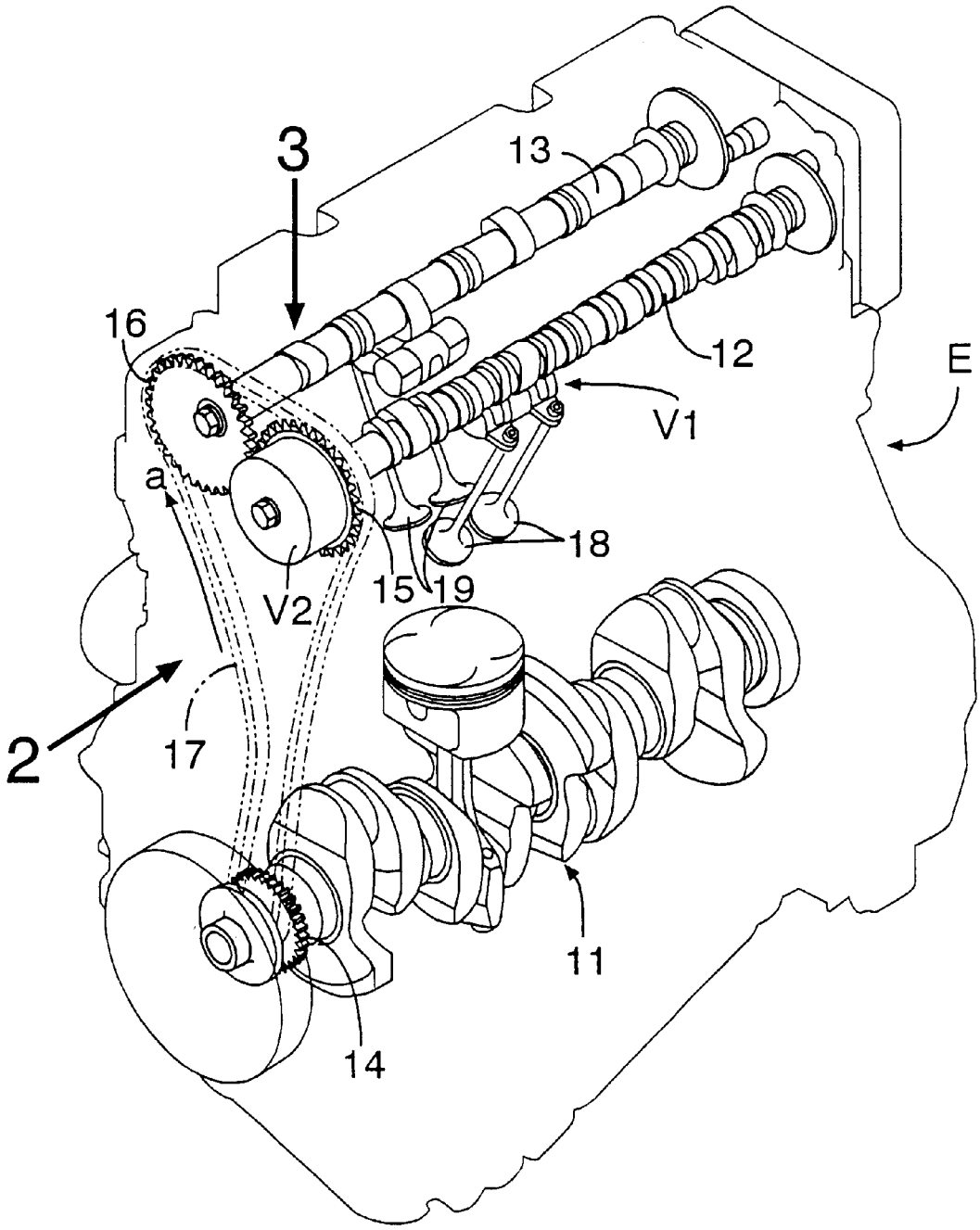
FIGS. 1 to 13 illustrate a first embodiment of the present invention.

As shown in FIG. 1, a DOHC type in-line four cylinder engine E has a crankshaft 11, an intake camshaft 12 and an exhaust camshaft 13. A timing chain 17 is wrapped around a crankshaft sprocket 14 provided on a shaft end of the crankshaft 11, an intake camshaft sprocket 15 provided on a shaft end of the intake camshaft 12 and an exhaust camshaft sprocket 16 provided on a shaft end of the exhaust camshaft 13. The timing chain 17 is driven in the direction of the arrow a by the crankshaft 11. The intake camshaft 12 and the exhaust camshaft 13 rotate at a speed that is half that of the crankshaft 11. Each of the cylinders has two intake valves 18 drive in by the intake camshaft 12 and two exhaust valves 19 driven by the exhaust camshaft 13. The amount of valve lift and the duration for which the valve is open for the two intake valves 18 can be controlled by a first variable valve operating characteristic mechanism V1 provided on each of the cylinders. The valve timing can be controlled by a second variable valve operating characteristic mechanism V2 provided on the shaft end of the intake camshaft 12.

Figure 2:
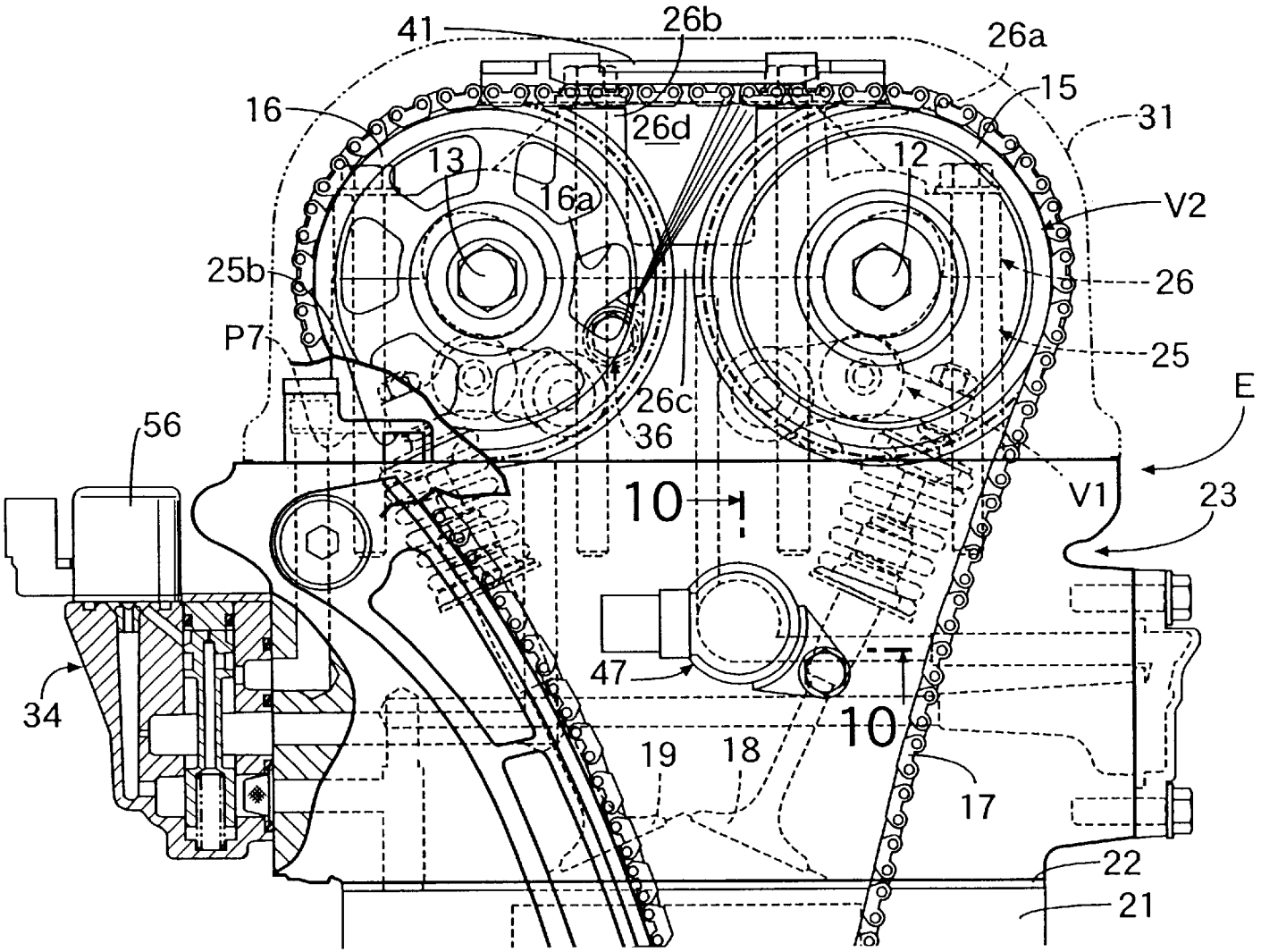
Figure 3:
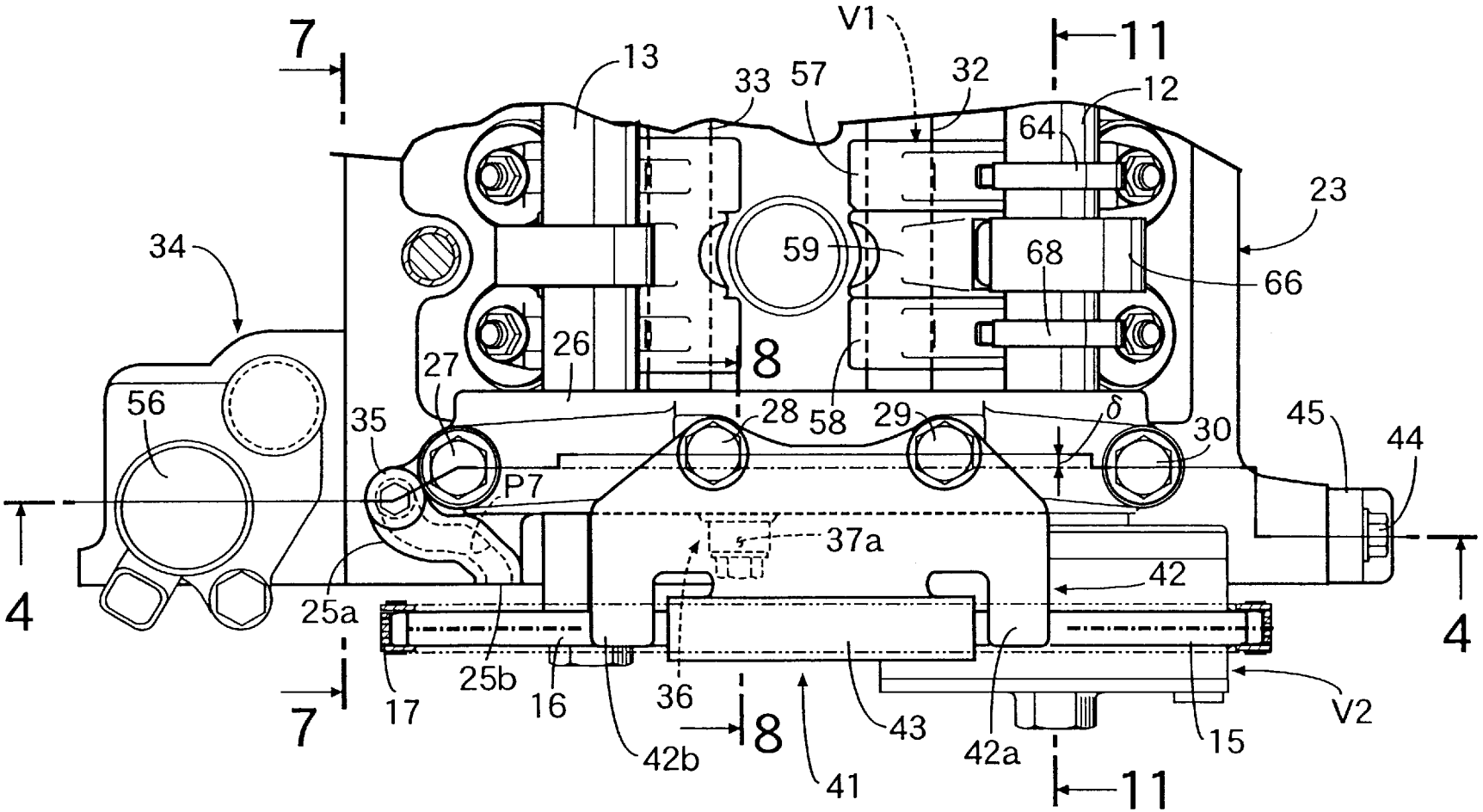
Figure 4:
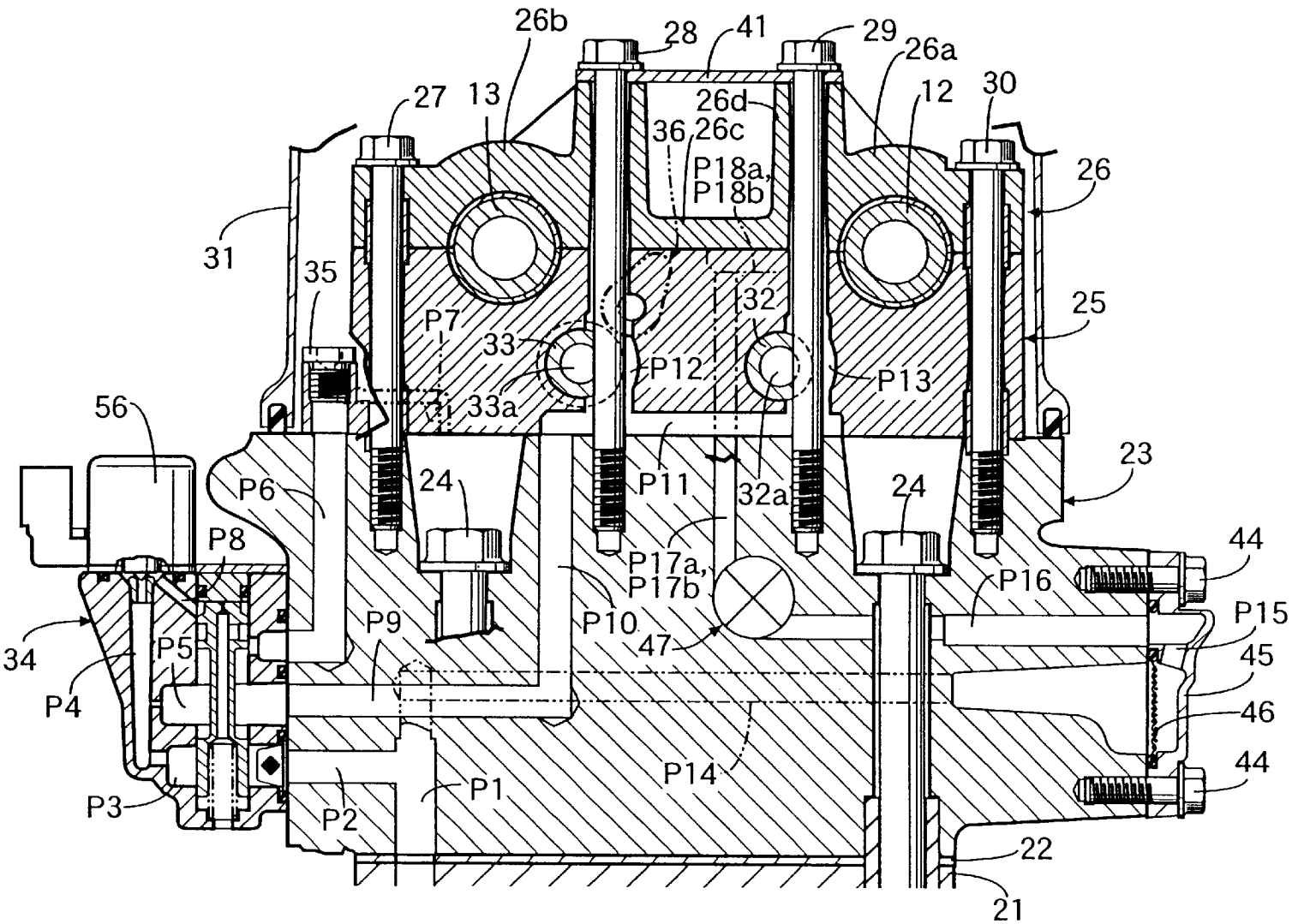

As shown in FIGS. 2 to 4, on the upper face of a cylinder block 21 is superimposed a cylinder head 23 via a gasket 22, and it is fastened by a plurality of bolts 24. On the upper face of the cylinder head 23 are superimposed a lower camshaft holder 25, which also functions as a rocker arm shaft holder, and an upper camshaft holder 26, and they are together fastened to the cylinder head 23 by four bolts 27, 28, 29 and 30. Upper parts of the lower camshaft holder 25 and the upper camshaft holder 26 are covered with a head cover 31. In the lower camshaft holder 25 are fixed an intake rocker arm shaft 32 and an exhaust rocker arm shaft 33. The intake camshaft 12 and the exhaust camshaft 13 are rotatably supported in the plane in which the lower camshaft holder 25 and the upper camshaft holder 26 are joined together.

Figure 5:
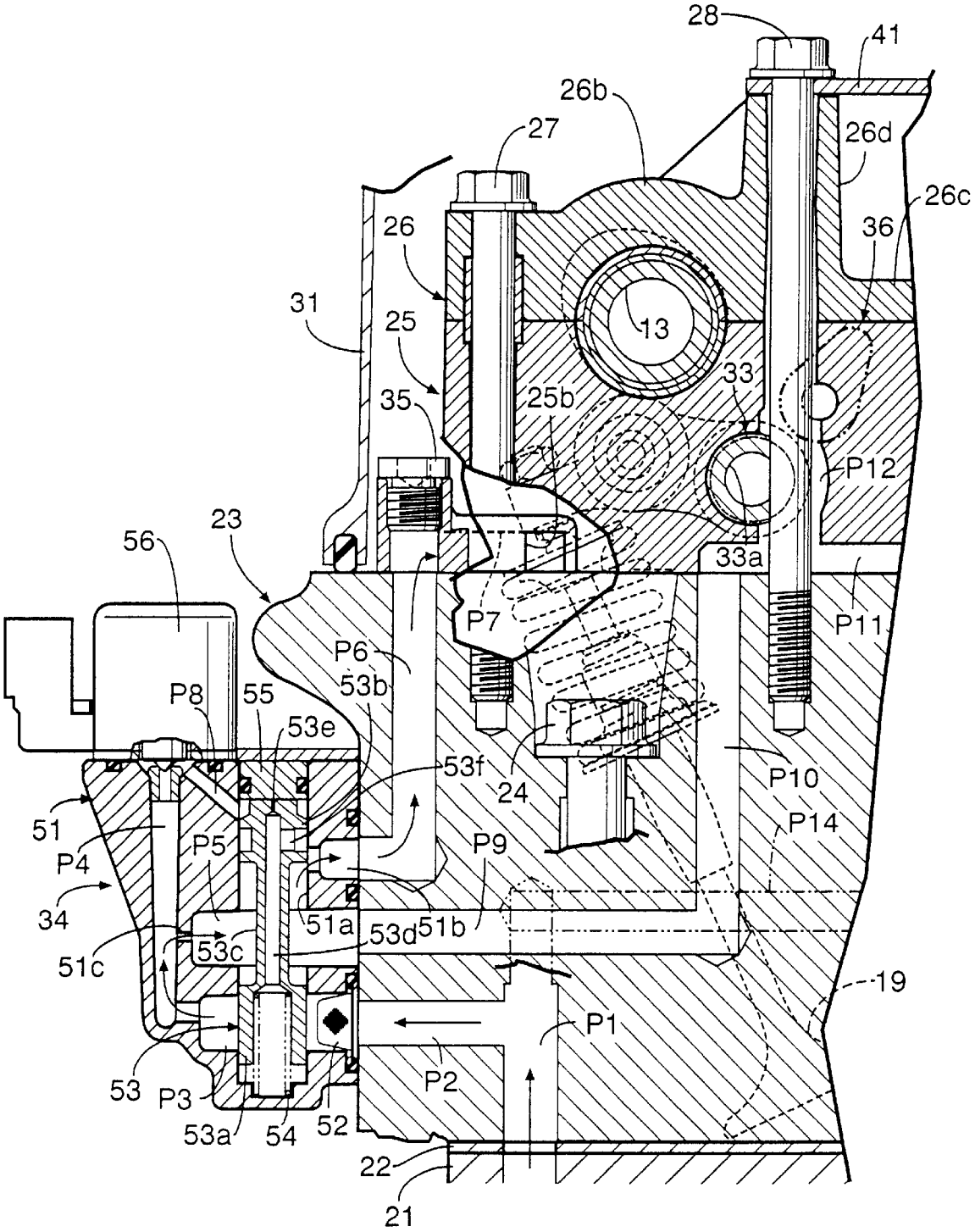
Figure 7:
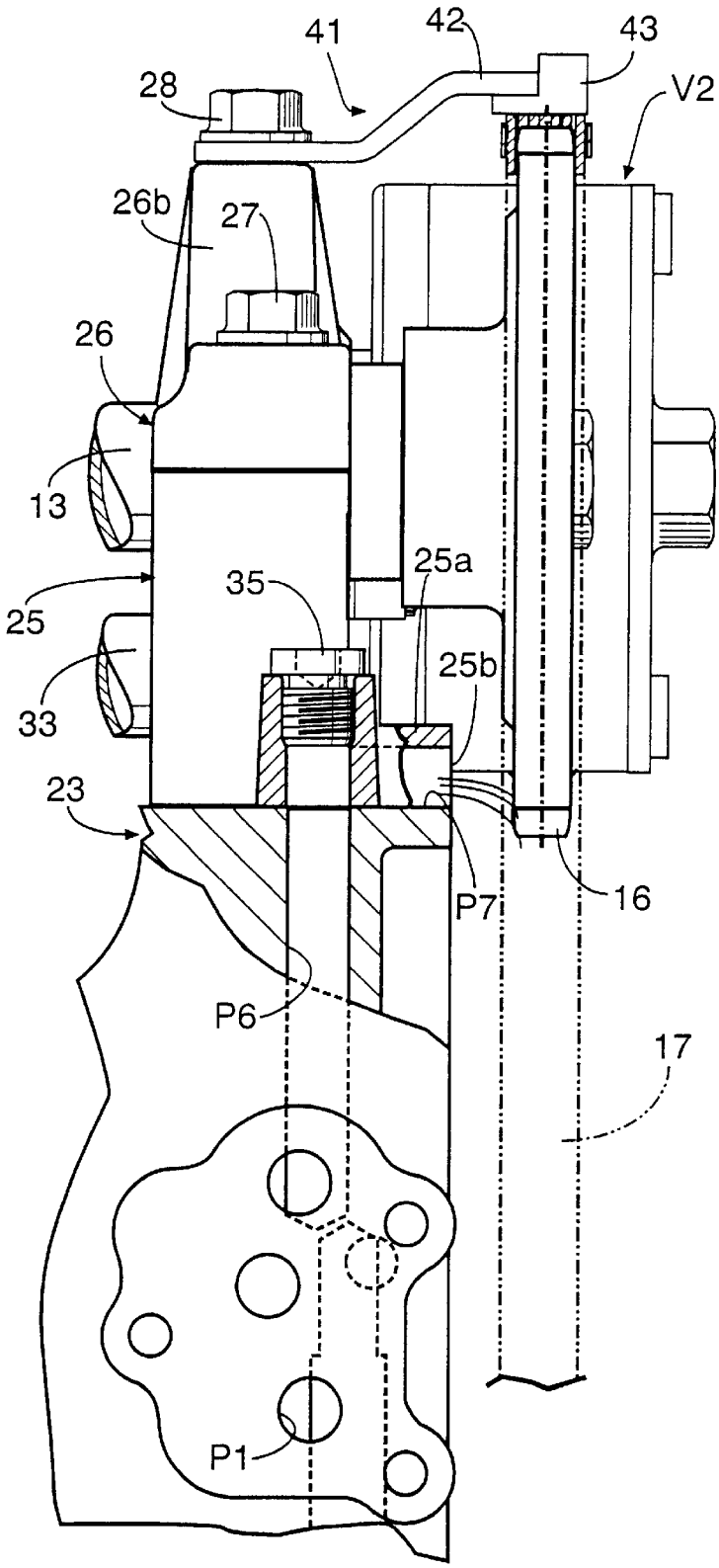

As is clear from referring to FIGS. 5 and 7 together, an oil passage P1 connected to an oil pump (not illustrated) driven by the crankshaft 11 is formed in the cylinder head 23, and an oil passage P2 branching from the oil passage P1 communicates with a first hydraulic control valve 34 mounted on the side of the cylinder head 23. An oil passage P6 that originates from the first hydraulic control valve 34 and goes through the inside of the cylinder head 23 further extends upward and communicates with an oil passage P7 formed on the lower face of a protruding expanded part 25*a* (the plane in which the protruding expanded part 25*a* and the cylinder head 23 are joined together), which is integral with the lower camshaft holder 25. At the downstream end of the oil passage P7 is formed an oil drain hole 25*b*, which is opposite the start of the section where the exhaust camshaft sprocket 16 is meshed with the timing chain 17. The oil drain hole 25*b* is slightly constricted in comparison with the cross section of the flow passage of the oil passage P7 so that the oil can reliably be supplied to the above-mentioned start of the meshed section. A blind cap 35 is provided on the upper face of the protruding expanded part 25*a* of the lower camshaft holder 25 at a position that is an extension of the oil passage P6 that extends upward within the cylinder head 23.

An oil passage P9 that originates from the first hydraulic control valve 34 and extends horizontally within the cylinder head 23 communicates with an oil passage P10 that extends upward. The oil passage P10 opens on the upper face of the cylinder head 23 and communicates with an oil passage P11 formed on the lower face of the lower camshaft holder 25. The oil passage P11 of the lower camshaft holder 25 communicates with oil passages P12 and P13 formed on the outer peripheries of the two bolts 28 and 29 of the four bolts 27 to 30 that fasten both the lower camshaft holder 25 and the upper camshaft holder 26 to the cylinder head 23. The oil passage P12 formed on the outer periphery of the bolt 28 communicates with both an oil passage 33*a* formed within the exhaust rocker arm shaft 33 in the axial direction and an oil jet 36 provided in the lower camshaft holder 25. The oil passage P13 formed on the outer periphery of the bolt 29 communicates with an oil passage 32*a* formed within the intake rocker arm shaft 32 in the axial direction.

Figure 8:
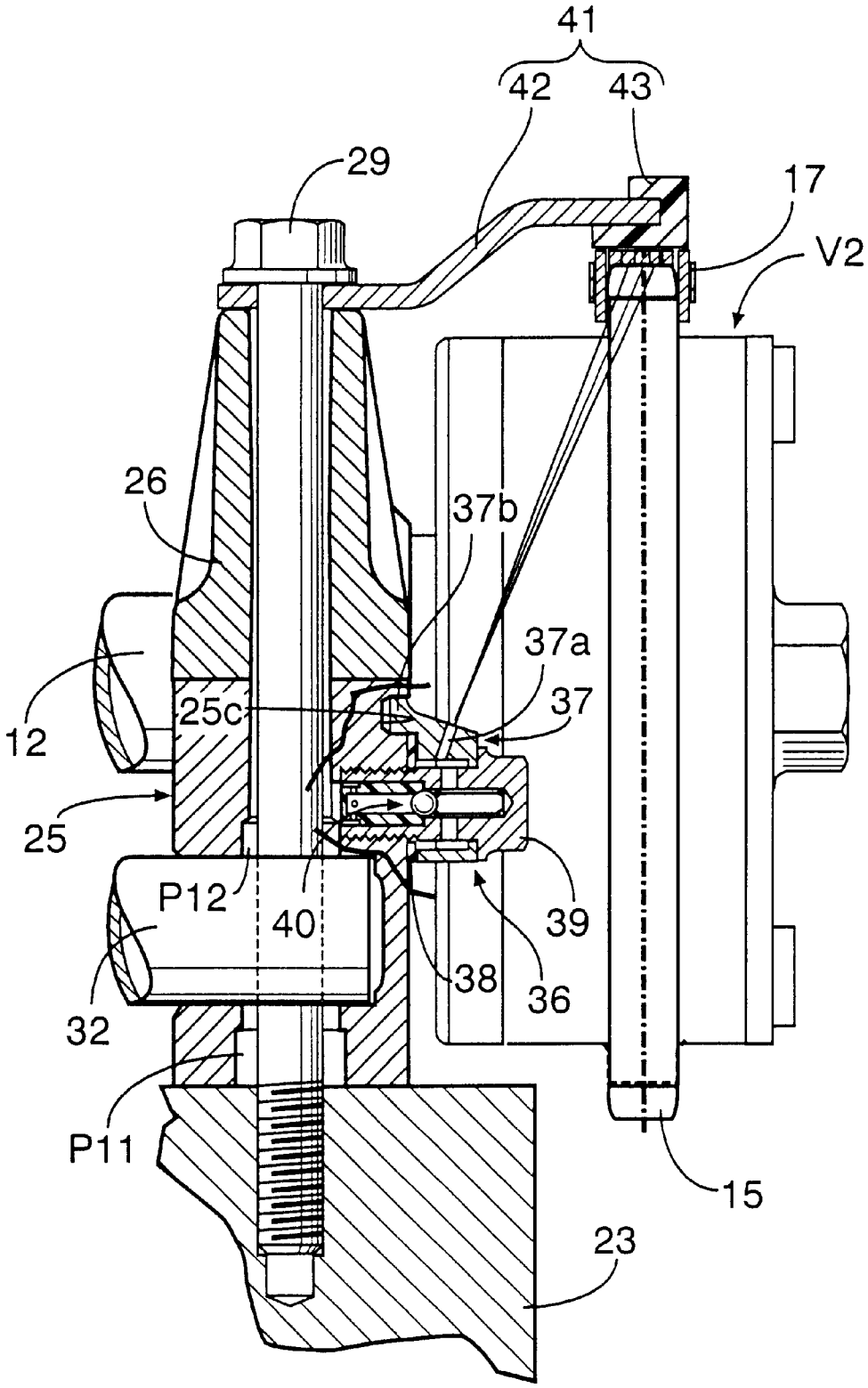

As is clear from FIG. 8, the oil jet 36 includes an oil jet main body 37 having a nozzle hole 37*a* and a mounting bolt 39 for fixing the oil jet main body 37 to the lower camshaft holder 25 via a sealing member 38. Within the mounting bolt 39 is housed a relief valve 40, the upstream side of the relief valve 40 communicating with the oil passage P12 formed on the outer periphery of the bolt 28 and the downstream side of the relief valve 40 communicating with the nozzle hole 37*a* of the oil jet main body 37. Fitting a positioning projection 37 *b* formed on the oil jet main body 37 in a positioning hole 25*c* formed in the lower camshaft holder 25 positions the nozzle hole 37*a* so that it is directed toward the start of the section where the intake camshaft sprocket 15 is meshed with the timing chain 17.

The oil jet 36 is placed in a dead space interposed between the lower camshaft holder 25 and the exhaust camshaft sprocket 16 so as to be housed within the outer diameter of the exhaust camshaft sprocket 16. It is therefore possible to minimize the influence on other members from mounting the oil jet 36. In particular, because the oil jet 36 is placed by effectively utilizing the dead space behind the exhaust camshaft sprocket 16, which is not where the second variable valve operating characteristic mechanism V2 is provided, it is possible to minimize any increase in the dimensions of the engine E and any interference with the mounting of other members from mounting the oil jet 36. As shown in FIG. 2, the oil jet 36 is opposite a cut-out hole 16*a* that is formed in the exhaust camshaft sprocket 16 in order to reduce the weight of the exhaust camshaft sprocket 16. That is to say, since the oil jet 36 faces the cut-out hole 16*a* formed in the exhaust camshaft sprocket 16, it is possible to easily check through the cut-out hole 16*a* the presence of the oil jet 36 and the state in which it is mounted.

If the entire mounting bolt 39 of the oil jet 36 is placed within the cut-out hole 16*a* of the exhaust camshaft sprocket 16, the mounting bolt 39 can be attached/detached through the cut-out hole 16*a*, thus enhancing the ease of maintenance. If the entire oil jet 36 is placed within the cut-out hole 16*a* of the exhaust camshaft sprocket 16, the oil jet 36 can be attached/detached through the cut-out hole 16*a*, thus enhancing the ease of maintenance.

As is clear from FIGS. 3, 4 and 8, a chain guide 41 is fastened by the two bolts 28 and 29 (inner bolts placed inside the intake camshaft 12 and the exhaust camshaft 13) that fasten the upper camshaft holder 26. The above-mentioned two bolts 28 and 29 that fasten the upper camshaft holder 26 are offset relative to the two bolts 27 and 30 (outer bolts placed outside the intake camshaft 12 and the exhaust camshaft 13) that are placed outside the two bolts 28 and 29 by a distance δ in a direction away from the oil jet 36. This allows a mounting space for the oil jet 36 to be secured while avoiding any interference with the bolts 28 and 29 and, moreover, the rigidity with which the oil jet 36 is supported can be enhanced.

Because one bolt 28 of the two offset bolts 28 and 29 overlaps the oil jet 36 in the axial direction of the exhaust camshaft 13, not only can the dimensions of the lower camshaft holder 25 be reduced, but also the rigidity with which the exhaust camshaft 13 is supported can be enhanced. This is because placing the oil jet 36 in a position closer to the bolt 29 than to the bolt 28 (on the side away from the exhaust camshaft 13) would increase the dimensions of the lower camshaft holder 25 by a proportion corresponding to the space required for the oil jet 36. If, on the other hand, the oil jet 36 were placed closer to the exhaust camshaft 13 side rather than to the bolt 28, it would be necessary to form a mounting hole for the oil jet 36 close to the face of the lower camshaft holder 25 that supports the exhaust camshaft 13 and there would, therefore, be a possibility that the rigidity with which the exhaust camshaft 13 is supported might be degraded. Furthermore, because the oil passage P12 extending to the oil jet 36 is formed around the above-mentioned bolt 28, the oil passages for supplying oil to the oil jet 36 can be arranged simply and at the same time the oil passages can be shortened.

The chain guide 41 has a chain guide main body 42 made of a metal sheet. The lower face of a sliding member 43 made of a synthetic resin provided at the extremity of the chain guide main body 42 is in sliding contact with the upper face of the timing chain 17. The sliding member 43 can guide the timing chain 17 while restricting its vibration so as to suppress wear of the timing chain 17, and the sliding resistance between the chain guide 41 and the timing chain 17 can thus be reduced. A pair of tooth skipping prevention plates 42*a* and 42*b* are formed integrally at both ends of the chain guide main body 42 in the longitudinal direction. One tooth skipping prevention plate 42*a* covers the start of the section where the intake camshaft sprocket 15 is meshed with the timing chain 17 and prevents tooth skipping of the timing chain 17. The other tooth skipping prevention plate 42*b* covers the end of the section where the exhaust camshaft sprocket 16 is meshed with the timing chain 17 and prevents tooth skipping of the timing chain 17. Because the rigidity of the chain guide 41 increases due to the presence of the two tooth skipping prevention plates 42*a* and 42*b*, the rigidity with which the intake camshaft 12 and the exhaust camshaft 13 are supported is further enhanced.

Because the tooth skipping prevention plates 42*a* and 42*b* are formed at the two ends of the sliding member 43 made of a synthetic resin, even through the sliding member 43 is made of a synthetic resin its durability is enhanced.

The upper camshaft holder 26 includes a cam cap 26*a* for restraining the intake camshaft 12, a cam cap 26*b* for restraining the exhaust camshaft 13 and a connecting wall 26*c* for providing a connection between the two caps 26*a* and 26*b*. Between the two bolts 28 and 29 and the connecting wall 26*c*, that is to say, on a face of the connecting wall 26*c* opposite the chain guide 41 is formed a U-shaped recess 26*d* for reducing the weight of the upper camshaft holder 26. In addition to the lower ends of the two cam caps 26*a* and 26*b* being connected to each other through the connecting wall 26*c*, the upper ends thereof are connected to each other by the chain guide 41. That is to say, because the chain guide 41 is mounted so as to bridge the recess 26*d* formed between the two cam caps 26*a* and 26*b* and the connecting wall 26*c*, the two cam caps 26*a* and 26*b* can be connected by means of both the connecting wall 26*c* and the chain guide 41 while reducing the weight of the upper camshaft holder 26 and maintaining an adequate rigidity and the rigidity with which the intake camshaft 12 and the exhaust camshaft 13 are supported can be enhanced.

As hereinbefore described, because the chain guide 41 is fastened by means of the two bolts 28 and 29 among the four bolts 27 to 30 that also fasten both the lower camshaft holder 25 and the upper camshaft holder 26 to the cylinder head 23, the number of parts is reduced and the rigidity with which the chain guide 41 is mounted is enhanced. Although the height of the seats for the two inner bolts 28 and 29 fixing the chain guide 41, among the above-mentioned four bolts 27 to 30, is restricted by the height of the timing chain 17, the height of the seats for the two outer bolts 27 and 30 that are not involved in the fixing of the chain guide 41 is not restricted by the height of the timing chain 17 and can be made low. It is thereby possible to lower the two ends of the upper camshaft holder 26 relative to the seats for the bolts 28 and 29 thus achieving a reduction in the dimensions of the head cover 31.

Referring again to FIG. 4, a filter housing 45 is fixed to a side of the cylinder head 23 by means of bolts 44. An oil passage P14 branching from the oil passage P1 of the cylinder head 23 extends in a direction away from the first variable valve operating characteristic mechanism V1 and communicates with an oil passage P16 of the cylinder head 23 via a filter 46 within the filter housing 45 and an oil passage P15. The oil passage P16 communicates with a second hydraulic control valve 47 housed within the cylinder head 23 (an end wall of the cylinder head 23 on the timing chain 17 side). The second hydraulic control valve 47 communicates with the outer periphery of the intake camshaft 12 via oil passages 17*a* and 17*b* formed in the cylinder head 23 and oil passages 18*a* and 18*b* formed in the lower camshaft holder 25. The filter housing 45 is mounted utilizing a space on the side of the cylinder head 23 that is opposite the side of the cylinder head 23 on which the first hydraulic control valve 34 is mounted.

Next, the structure of the first hydraulic control valve 34 is explained by reference to FIG. 5.

The first hydraulic control valve 34 provided on the side of the cylinder head 23 has a valve hole 51*a* formed within a valve housing 51. The two ends of an oil passage P3 passing through a lower part of the valve hole 51*a* communicate with the oil passage P2 and an oil passage P4 respectively. The two ends of an oil passage P5 passing through a middle part of the valve hole 51*a* communicate with the oil passage P9 and the oil passage P4 respectively. An upper part of the valve hole 51*a* communicates with the oil passage P6 via a drain port 51*b*. A filter 52 is attached to the entrance of the oil passage P3. On a spool 53 housed within the valve hole 51*a* are formed a pair of lands 53*a* and 53*b*, a groove 53*c* interposed between the two lands 53*a* and 53*b*, an inner hole 53*d* extending in the axial direction, an orifice 53*e* passing through the upper end of the inner hole 53*d*, and a groove 53*f* providing communication between the inner hole 53*d* and the drain port 51*b*. The spool 53 is forced upward by a spring 54 housed in the lower end of the inner hole 53*d* and is in contact with a cap 55 blocking the upper end of the valve hole 51*a*. The oil passage P4 and the oil passage P5 communicate with each other via an orifice 51*c*. An ON/OFF solenoid 56 is provided between the oil passage P4 and an oil passage P8 so as to allow or block communication therebetween.

Next, the structure of the first variable valve operating characteristic mechanism V1 is explained by reference to FIG. 9.

The first variable valve operating characteristic mechanism V1 for driving the intake valves 18 includes first and second low speed rocker arms 57 and 58 pivotally supported on the intake rocker arm shaft 32 in a rockable manner and a high speed rocker arm 59 interposed between the two low speed rocker arms 57 and 58. Sleeves 60, 61 and 62 are press-fitted into the middle sections of the corresponding rocker arms 57, 58 and 59. A roller 63 that is rotatably supported around the sleeve 60 is in contact with a low speed intake cam 64 provided on the intake camshaft 12. A roller 65 that is rotatably supported around the sleeve 61 is in contact with a high speed intake cam 66 provided on the intake camshaft 12. A roller 67 that is rotatably supported around the sleeve 62 is in contact with a low speed intake cam 68 provided on the intake camshaft 12. The cam lobe of the high speed intake cam 66 is made higher than the cam lobes of the pair of low speed intake cams 64 and 68, which have an identical profile.

A first switch-over pin 69, a second switch-over pin 70 and a third switch-over pin 71 are slidably supported within the three sleeves 60, 61 and 62. The first switch-over pin 69 is forced toward the second switch-over pin 70 by a spring 73 disposed in a compressed manner between the first switch-over pin 69 and the spring seat 72 fixed to the sleeve 60 and stops in a position in which the first switch-over pin 69 is in contact with a clip 74 fixed to the sleeve 60. At this point, the plane in which the first switch-over pin 69 and the second switch-over pin 70 are in contact with each other is positioned between the first low speed rocker arm 57 and the high speed rocker arm 59, and the plane in which the second switch-over pin 70 and the third switch-over pin 71 are in contact with each other is positioned between the high speed rocker arm 59 and the second low speed rocker arm 58. An oil chamber 58*a* formed within the second low speed rocker arm 58 communicates with the oil passage 32*a* formed within the intake rocker arm shaft 32.

Figure 9:
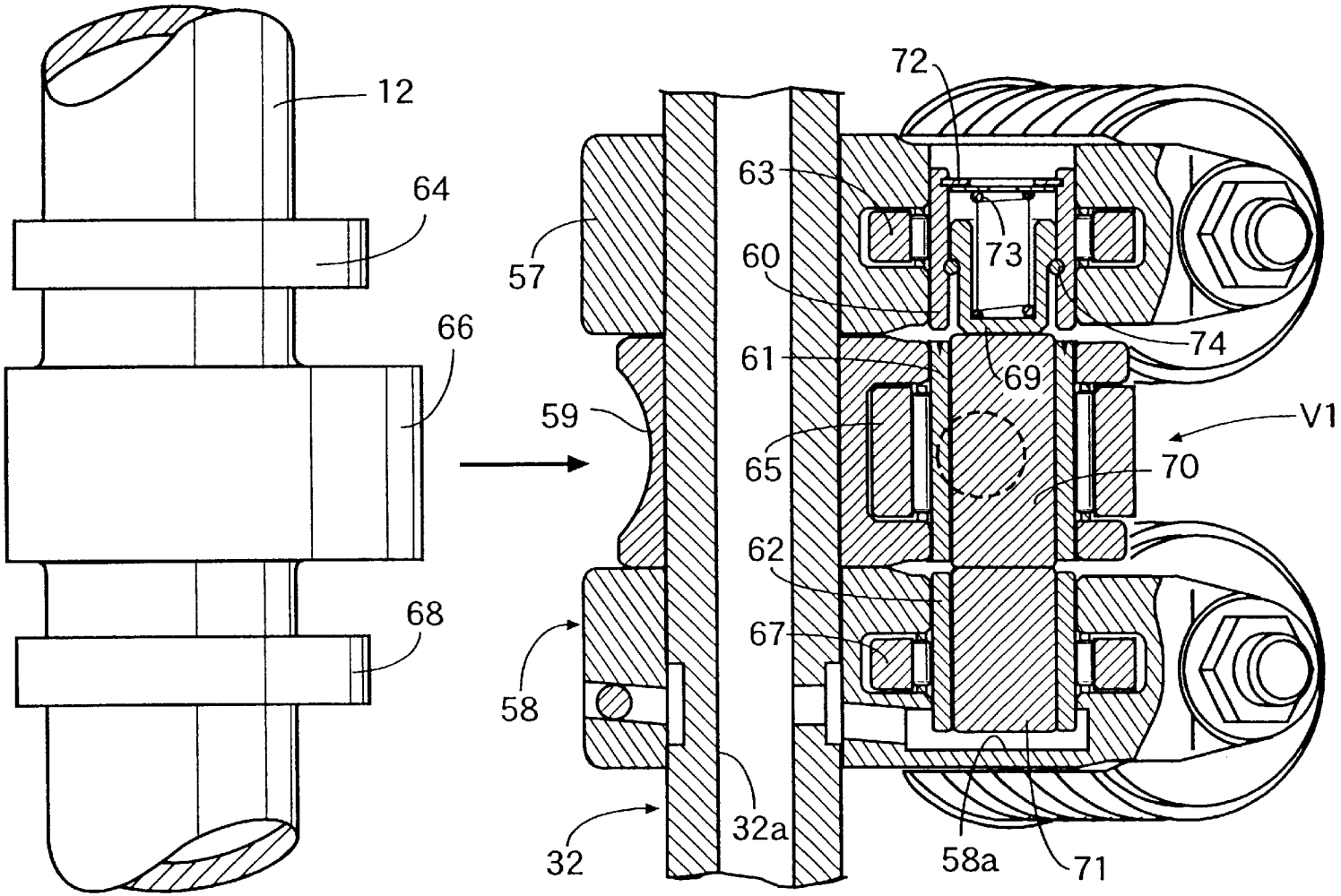

When no hydraulic pressure acts on the oil passage 32*a* of the intake rocker arm shaft 32, the first to third switch-over pins 69 to 71 are in the positions shown in FIG. 9. The first and second low speed rocker arms 57 and 58 and the high speed rocker arm 59 can rock freely. The pair of intake valves 18 are therefore driven with a low valve lift by the first low speed rocker arm 57 and the second low speed rocker arm 58 respectively. At this point, the high speed rocker arm 59 is detached from the first low speed rocker arm 57 and the second low speed rocker arm 58 and rotates without effect on the action of the pair of intake valves 18.

When a hydraulic pressure acts on the oil chamber 58*a* through the oil passage 32*a* of the intake rocker arm shaft 32, the first to third switch-over pins 69 to 71 move against the spring 73, and the first and second low speed rocker arms 57 and 58 and the high speed rocker arm 59 are united. As a result, the first and second low speed rocker arms 57 and 58 and the high speed rocker arm 59 are driven as a unit by the high speed intake cam 66 having the high cam lobe, and the pair of intake valves 18 connected to the first low speed rocker arm 57 and the second low speed rocker arm 58 are driven with a high valve lift. At this point, the pair of low speed intake cams 64 and 68 are detached from the first and second low speed rocker arms 57 and 58 and rotate without effect.

Figure 10:
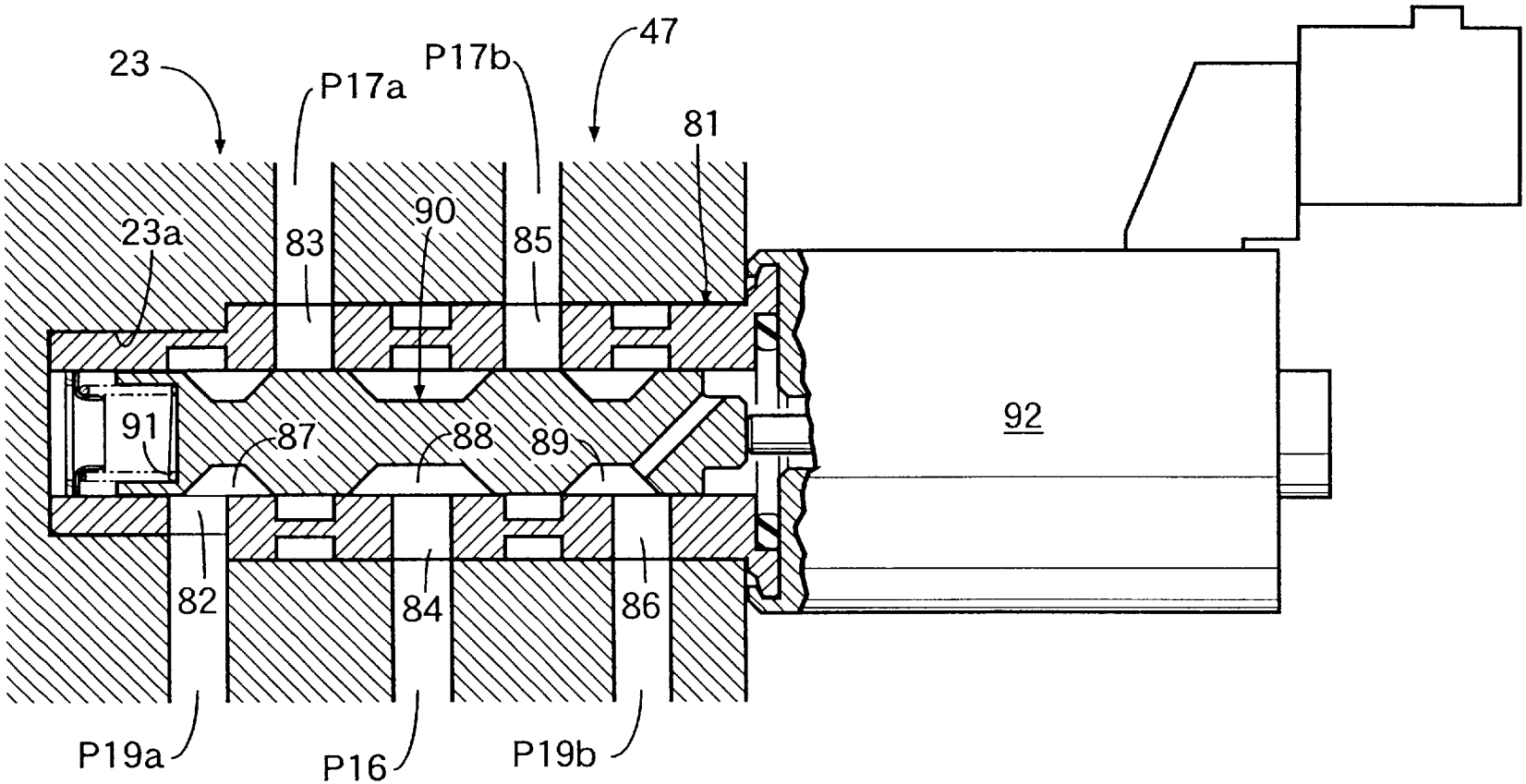

Next, the structure of the second hydraulic control valve 47 is explained by reference to FIG. 10.

Five ports 82 to 86 are formed in a cylindrical valve housing 81 fitted in a valve hole 23*a* formed in the cylinder head 23. The central port 84 communicates with the oil passage P16, the ports 83 and 85 that are on lighter side of the central port 84 communicate with the pair of oil passages P17*a* and P17*b* respectively, and the ports 82 and 86 that are outside ports 83 and 85 communicate with a pair of oil drainage passages P19*a* and P19*b* respectively. Three grooves 87, 88 and 89 are formed on the outer periphery of a spool 90. The spool 90 is slidably fitted in the valve housing 81 and forced by the resilient force of a spring 91 toward a linear solenoid 92, the spring being disposed on one end of the spool 90 and the solenoid 92 being disposed on the other end thereof.

When the spool 90 is in a neutral position as shown in the figure, all of the oil passages P16, P17*a* and P17*b* are blocked. When the spool 90 is moved leftward from the neutral position by duty control of the linear solenoid 92, the oil passage P16 communicates with the oil passage P17*a* via the port 84, the groove 88 and the port 83 and the oil passage P17*b* communicates with the oil passage 19*b* via the port 85, the groove 89 and the port 86. When the spool 90 is moved rightward from the neutral position by duty control of the linear solenoid 92, the oil passage P16 communicates with the oil passage P17*b* via the port 84, the groove 88 and the port 85, and the oil passage P17*a* communicates with the oil passage 19*a* via the port 83, the groove 87 and the port 82.

Next, the structure of the second variable valve operating characteristic mechanism V2 is explained by reference to FIGS. 11 and 12.

The second variable valve operating characteristic mechanism V2 includes an outer rotor 93 and an inner rotor 96 fixed to the intake camshaft 12 by means of a pin 94 and bolts 95. The outer rotor 93 includes a cap-shaped housing 97, the intake camshaft sprocket 15 being formed integrally on the outer periphery of the housing 97, an outer rotor main body 98 fitted in the housing 97 and an annular cover plate 99 covering the opening of the housing 97, and these are combined integrally by means of four bolts 100. A support hole 97*a* is formed in the center of the housing 97, and fitting the support hole 97*a* around the outer periphery of the intake camshaft 12 allows the outer rotor 93 to be supported on the intake camshaft 12 in a relatively rotatable manner.

On the inner periphery of the outer rotor main body 98 are alternately formed four recesses 98*a* and four projections 98*b*. Four vanes 96*a* formed radially on the outer periphery of the inner rotor 96 are fitted in the above-mentioned four recesses 98*a* respectively. Sealing members 101 provided on the extremities of the projections 98*b* of the outer rotor main body 98 are in contact with the inner rotor 96 and sealing members 102 provided on the extremities of the vanes 96*a* of the inner rotor 96 are in contact with the outer rotor main body 98 thus defining four advance chambers 103 and four retard chambers 104 between the outer rotor main body 98 and the inner rotor 96.

A stopper pin 105 is slidably supported in a pin hole 96*b* formed in the inner rotor 96. An arc-shaped long channel 97*b* with which the extremity of the stopper pin 105 can engage is formed in the housing 97 of the outer rotor 93. The stopper pine 105 is forced by a spring 106 in the direction in which the stopper pin 105 becomes detached from the long channel 97*b*. An oil chamber 107 is formed at the back of the stopper pin 105. When the stopper pin 105 becomes detached from the long channel 97*b* due to the resilient force of the spring 106, the outer rotor 93 and the inner rotor 96 can rotate relative to each other within an angle $\alpha$ (e.g. 30°) in which each of the vanes 96*a* of the inner rotor 96 can move from one end of the corresponding recess 98*a* of the outer rotor 93 to the other end thereof. When a hydraulic pressure is supplied to the oil chamber 107 thus making the stopper pin 105 engage with the long channel 97*b*, the outer rotor 93 and the inner rotor 96 can rotate relative to each other within an angle $\beta$ (e.g. 20°) in which the stopper 105 can move from one end of the long channel 97*b* to the other end thereof.

A pair of oil passages P18*a* and P18*b* formed in the lower camshaft holder 25 communicate with the advance chambers 103 and the retard chambers 104 respectively via a pair of oil passages 12*a* and 12*b* formed within the intake camshaft 12 and oil passages 96*c* and 96*d* formed in the inner rotor 96. When a hydraulic pressure is supplied to the advance chambers 103 via the second hydraulic control valve 47, the low speed intake cams 64 and 68 and the high speed intake cam 66 advance in angle relative to the intake camshaft 12 thus advancing the valve timing of the intake valves 18. On the other hand, when a hydraulic pressure is supplied to the retard chambers 104 via the second hydraulic control valve 47, the low speed intake cams 64 and 68 and the high speed intake cam 66 are retarded in angle relative to the intake camshaft 12 thus retarding the valve timing of the intake valves 18.

In the second lower camshaft holder 25 viewed from the second variable valve operating characteristic mechanism V2 side, is formed an oil passage P20 that communicates with the oil passage P13 (FIG. 4). The oil passage P20 further communicates with the oil chamber 107, the top part of the stopper pin 105 facing the oil chamber 107, via an oil passage 12*c* formed within the intake camshaft 12 and oil passages 95*a* and 95*b* formed within the bolt 95.

In the present embodiment, no variable valve operating characteristic mechanism, is provided on the exhaust camshaft 13 side, and the exhaust valves 19 are drive with an intermediate valve lift. That is to say, the valve lift of the exhaust valves 19 is midway between the valve lift (small lift) of the intake valves 18 at low speed and the vale lift (large lift) at high speed.

The action of the embodiment having the above-mentioned arrangement is now explained.

When the engine E rotates at a low speed, the solenoid 56 of the first hydraulic control valve 34 is in an OFF state, communication between the oil passage P4 and the oil passage P8 is blocked, and the spool 53 is in the raised position shown in FIG. 5 due to the resilient force of the spring 54. In this state the oil pump communicates with the oil chamber 58*a* of the first variable valve operating characteristic mechanism V1 via the oil passage P1 and P2 of the cylinder head 23, the oil passages P3 and P4, the orifice 53*c* and the oil passage P5 of the valve housing 51, the oil passages P9 and P10 of the cylinder head 23, the oil passages P11 and P13 of the lower camshaft holder 25 and the oil passage 32*a* within the intake rocker arm shaft 32. At this point, because the hydraulic pressure that is transmitted to the oil chamber 58*a* of the first variable valve operating characteristic mechanism V1 is low as a result of the action of the orifice 53*c*, the first to third switch-over pins 69, 70 and 71 are retained in the positions shown in FIG. 9, the pair of intake valves 18 are driven with a low valve lift and the valve operation system (rocker arm support parts, camshaft support parts, etc.) can be lubricated with this low pressure oil.

Figure 11:
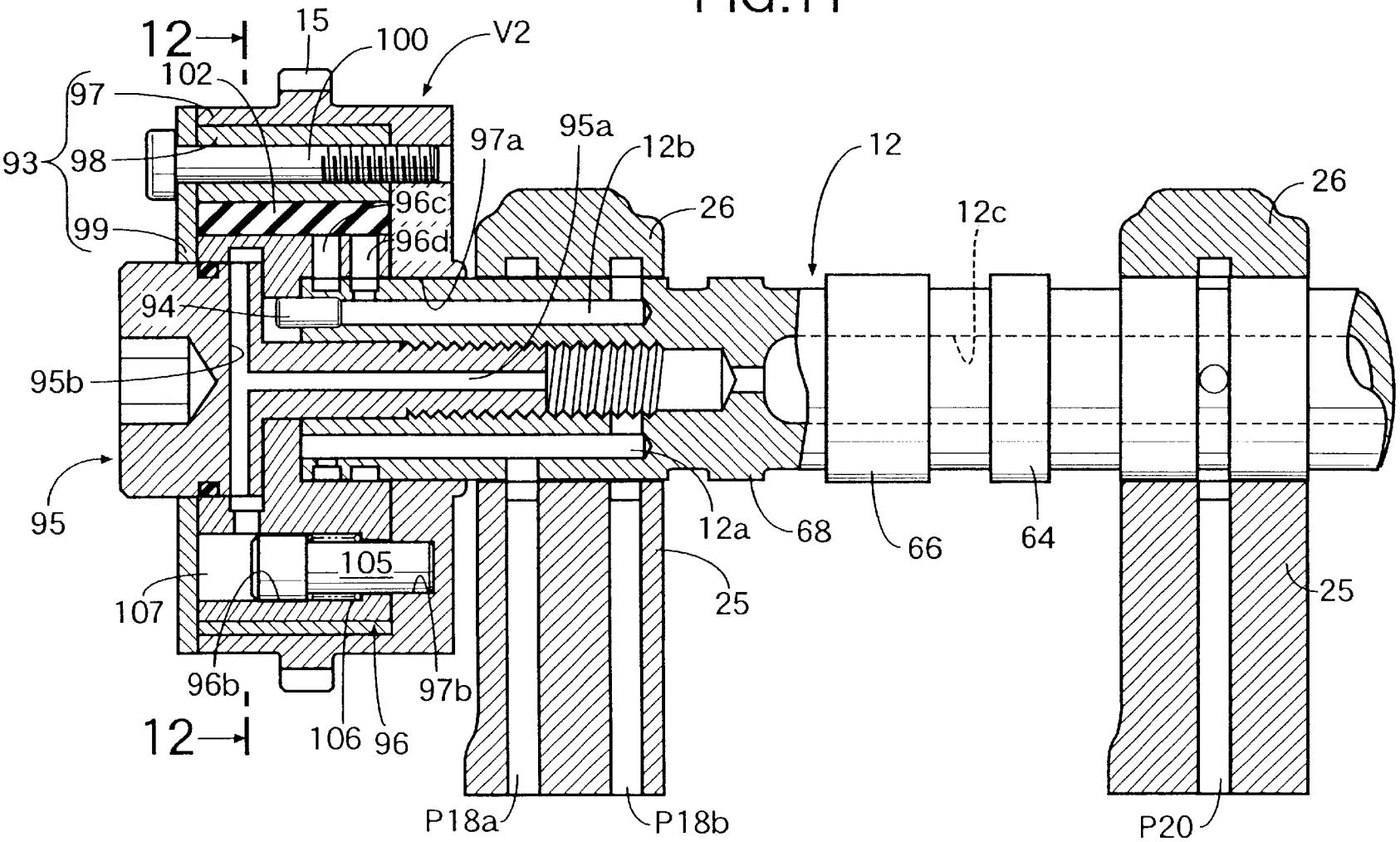
Figure 12:
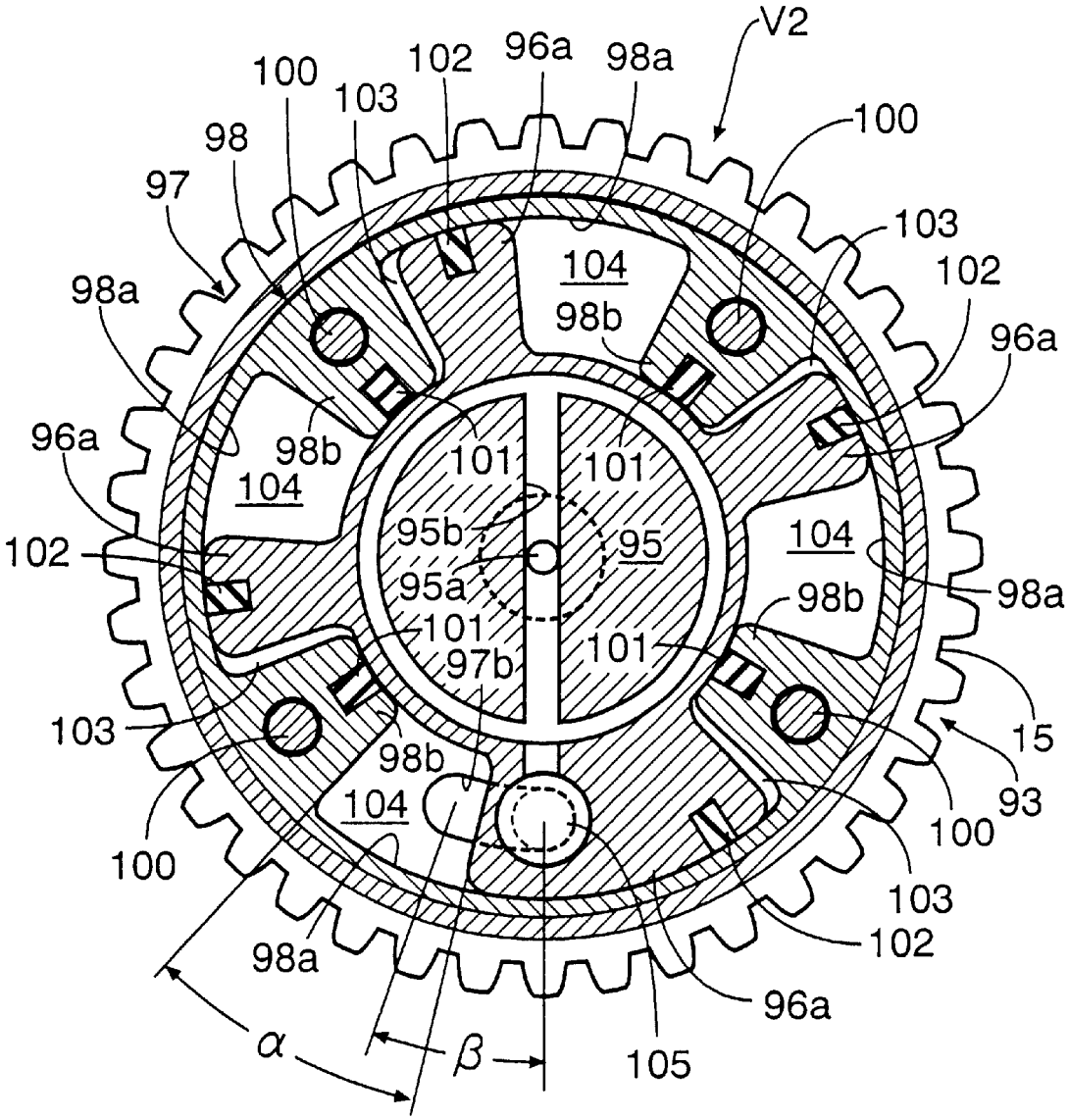

As described above, when the hydraulic pressure output by the first hydraulic control valve 34 is low, the hydraulic pressure that is transmitted to the oil chamber 107 of the second variable valve operating characteristic mechanism V2 via the oil passage P20 of the lower camshaft holder 25 and the oil passage 12*c* within the intake camshaft 12 shown in FIG. 11 is slow, and the stopper pin 105 becomes detached from the long channel 97*b* due to the resilient force of the spring 106. Controlling the duty ratio of the second hydraulic control valve 47 (FIG. 10), which is connected to the oil pump via the oil passages P1 and P14 of the cylinder head 23, the oil passage P15 within the filter housing 45 and the oil passage P16 of the cylinder head 23, generates a difference between the hydraulic pressures transmitted via the pair of oil passages 17*a* and 17*b* to the advance chambers 103 and the retard chambers 104 of the second variable valve operating characteristic mechanism V2. As a result, the phase of the inner rotor 96 relative to the outer rotor 93 can be varied in the range of the angle $\alpha$ (FIG. 12) thus controlling the valve timing of the intake valves 18.

When the engine E rotates at low speed as described above, the oil (relief oil) that has passed through the orifice 53*c* of the first hydraulic control valve 34 and has a reduced pressure flows through the oil passage P5, the groove 53*c* of the spool 53, the drain port 51*b*, the oil passage P6 of the cylinder head 23 and the oil passage P7 of the protruding expanded part 25*a* of the lower camshaft holder 25 and flows out of the oil drain hole 25*b* to the start of the section (or meshed section) where the exhaust camshaft sprocket 16 is meshed with the timing chain 17 thus lubricating the timing chain 17 (FIG. 7). Because the rotational speed of the timing chain 17 is low when the engine E rotates at a low speed, only a small amount of the oil that has become attached to the timing chain 17 scatters due to centrifugal force. If oil is supported to the start of the section where the exhaust camshaft sprocket 16 is meshed with the timing chain 17, which is to the rear in the rotational direction of the timing chain 17, because the engine E is rotating at a low speed with a small load imposed on the timing chain 17, the section where the intake camshaft sprocket 15 is meshed with the timing chain 17, which is to the front in the rotational direction of the timing chain 17, can be lubricated well.

As hereinbefore described, since the timing chain 17 is lubricated with the relief oil of the first hydraulic control valve 34 flowing out through the oil drain hole 25*b*, it is unnecessary to employ an oil jet and secure a space for mounting it. Moreover, because the oil passage P7 connected to the oil drain hole 25*b* is formed in the plane in which the cylinder head 23 and the lower camshaft holder 25 are joined together, the oil passage P7 can be arranged simply. Furthermore, because the first hydraulic control valve 34 is mounted on the side wall of the cylinder head 23 that is close to the oil drain hole 25*b*, the length of the oil passage P7 for the above-mentioned relief oil can be reduced and the rigidity with which the first hydraulic control valve 34 is mounted can be enhanced in comparison with a case where the first hydraulic control valve 34 is mounted on a side wall of the cylinder head that is far from the oil drain hole 25*b*.

Furthermore, because the oil passage P7 for the relief oil, which is formed in the plane in which the cylinder head 23 and the lower camshaft holder 25 are joined together, and the first hydraulic control valve 34 are placed in a same plane that is perpendicular to the camshafts 12 and 13, the lengths of the oil passages P6 and P7 from the first hydraulic control valve 37 to the oil drain hole 25*b* can be further reduced.

Figure 6:
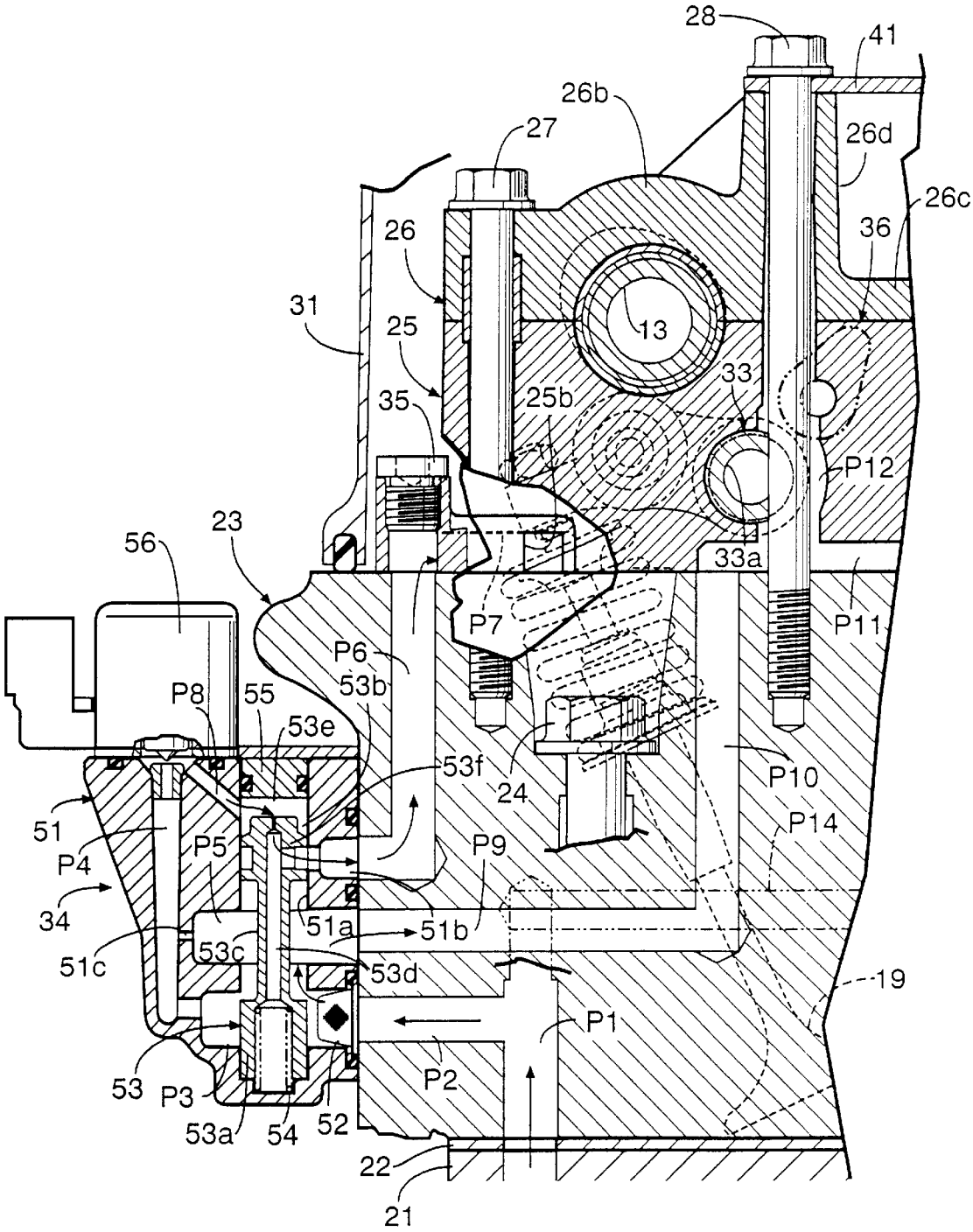

As shown in FIG. 6, when the engine E rotates at a high speed and the solenoid 56 of the first hydraulic control valve 34 is in an ON state thus providing communication between the oil passage P4 and the oil passage P8 and moving the spool 53 downward due to the hydraulic pressure acting on the land 53*b*, the oil passage P3 and the oil passage P5 communicate with each other via the groove 53*c*. As a result, a high hydraulic pressure is transmitted to the oil chamber 58*a* of the first variable valve operating characteristic mechanism V1 via the oil passages P9 and P10 of the cylinder head 23, the oil passages P11 and P13 of the lower camshaft holder 25 and the oil passage 32*a* within the intake rocker arm shaft 32, the first to third switch-over pins 69, 70 and 71 move against the spring 73 and the pair of intake valves 18 are driven with a high valve lift.

As hereinbefore described, when the hydraulic pressure output by the first hydraulic control valve 34 is high, the hydraulic pressure that is transmitted to the oil chamber 107 of the second variable valve operating characteristic mechanism V2 via the oil passage P20 of the lower camshaft holder 25 and the oil passage 12*c* within the intake camshaft 12 shown in FIG. 11 also becomes high thus engaging the stopper pin 105 with the long channel 97*b* against the spring 106. It is therefore possible by controlling the duty ratio of the second hydraulic control valve 47, which is connected to the oil pump via the oil passages P1 and P14 of the cylinder head 23, the oil passage P15 within the filter housing 45 and the oil passage p16 of the cylinder head 23, to generate a difference between the hydraulic pressures transmitted via the pair of oil passages P17*a* and P17*b* to the advance chambers 103 and the retard chambers 104 of the second variable valve operating characteristic mechanism V2 thus varying the phase of the inner rotor 96 relative to the outer rotor 93 in the range of the angle 62 (FIG. 12), so as to control the valve timing of the intake valves 18.

In FIG. 8, when the engine E rotates at high speed, oil at a high pressure supplied to the oil passage P12 formed on the outer periphery of the bolt 28 pushes the relief valve 40 within the mounting bolt 39 of the oil jet 36 so as to open it and issues from the nozzle hole 37*a* of the oil jet main body 37 thus lubricating the start of the section (or meshed section) where the intake camshaft sprocket 15 is meshed with the timing chain 17. In FIG. 6, the oil supplied to the oil passage P8 of the first hydraulic control valve 34 flows through the orifice 53*e*, the inner hole 53*d* and the groove 53*f* of the spool 53, the drain port 51*b* of the valve housing 51, the oil passage P6 of the cylinder head 23 and the oil passage P7 of the protruding expanded part 25*a* of the lower camshaft holder 25 and flows out from the oil drain hole 25*b* toward the start of the section (or meshed section) where the exhaust camshaft sprocket 16 is meshed with the timing chain 17 thus lubricating the timing chamber 17 (FIG. 7).

As described above, when the engine E rotates at a low speed with a low load on the timing chain 17, only the start of the section where the exhaust camshaft sprocket 16 is meshed with the timing chain 17 is lubricated with the relief oil. When the engine E rotates at a high speed with a high load on the timing chain 17, the start of the section where the intake camshaft sprocket 15 is meshed with the timing chain 17 is lubricated intensively with oil from the oil jet 36 and at the same time the start of the section where the exhaust camshaft sprocket 16 is meshed with the timing chain 17 receives auxiliary lubrication with the relief oil from the oil drain hole 25*b*. The timing chain 17 can thus be lubricated optimally according to the operational state of the engine E thus enhancing the durability.

That is to say, because the operation of the oil drain hole 25*b* and the oil jet 36, which form a plurality of oil supply means for supplying oil to the timing chain 17, are controlled according to the operational state of the engine E, lubrication can be carried out according to the operational state of the engine E thus suppressing the wear of the timing chain 17. Moreover, because the number of oil supply means that are operated is increased as the rotational speed of the engine E increases, the number of parts that are lubricated is increased as the load increases and wear of the timing chain 17 can be suppressed yet more effectively.

In particular, when the engine E rotates at a low speed and the valve lift of the exhaust valves 19 (intermediate valve lift) is larger than the valve lift of the intake valves 18 (small valve lift), a comparatively large amount of oil is supplied to the exhaust camshaft sprocket 16, the load on the exhaust camshaft sprocket 16 being larger than that on the intake camshaft sprocket 15. On the other hand, when the engine E rotates at a high speed and the valve lift of the intake valves 18 (large valve lift) is larger than the valve lift of the exhaust valves 19 (intermediate valve lift), a comparatively large amount of oil is supplied to the intake camshaft sprocket 15, the load on the intake camshaft sprocket 15 being larger than that on the exhaust camshaft sprocket 16, a comparatively small amount of oil is supplied to the exhaust camshaft sprocket 16, and supply of an optimal amount of oil can thus be guaranteed according to the operational state of the engine E.

That is to say, the first variable valve operating characteristic mechanism V1 is provided to varying the relative amount of valve lift between the intake valves 18 and the exhaust valves 19 according to the operational state of the engine E, the amount of oil supplied to the section where the timing chain 17 is meshed with the sprocket that drives the valves having a larger lift being larger than the amount of oil supplied to the section where the timing chain 17 is meshed with the sprocket that drives the valves having a smaller lift, and a larger amount of oil can thus be supplied to the sprocket having a larger valve operating load thus prolonging the lift span of the timing chain 17. Moreover, the first hydraulic control valve 34 is provided for switching over between a low speed valve lift and a high speed valve lift, the low speed valve lift being used when the rotational speed of the engine E is lower than a predetermined value and the high speed valve lift being used when the rotational speed of the engine E is higher than the predetermined value. The first hydraulic control valve 34 establishes the low speed valve lift when the engine E rotates at a low speed and the high speed valve lift when the engine E rotates at a high speed; when the low speed valve lift from the first hydraulic control valve 34, and when the high speed valve lift is established, the timing chain 17 is lubricated with high pressure valve lift control oil from the first hydraulic control valve 34, and an amount of oil that is appropriate for the state of the load can thus be supplied to the timing chain 17 thus effectively preventing wear thereof.

Figure 13:
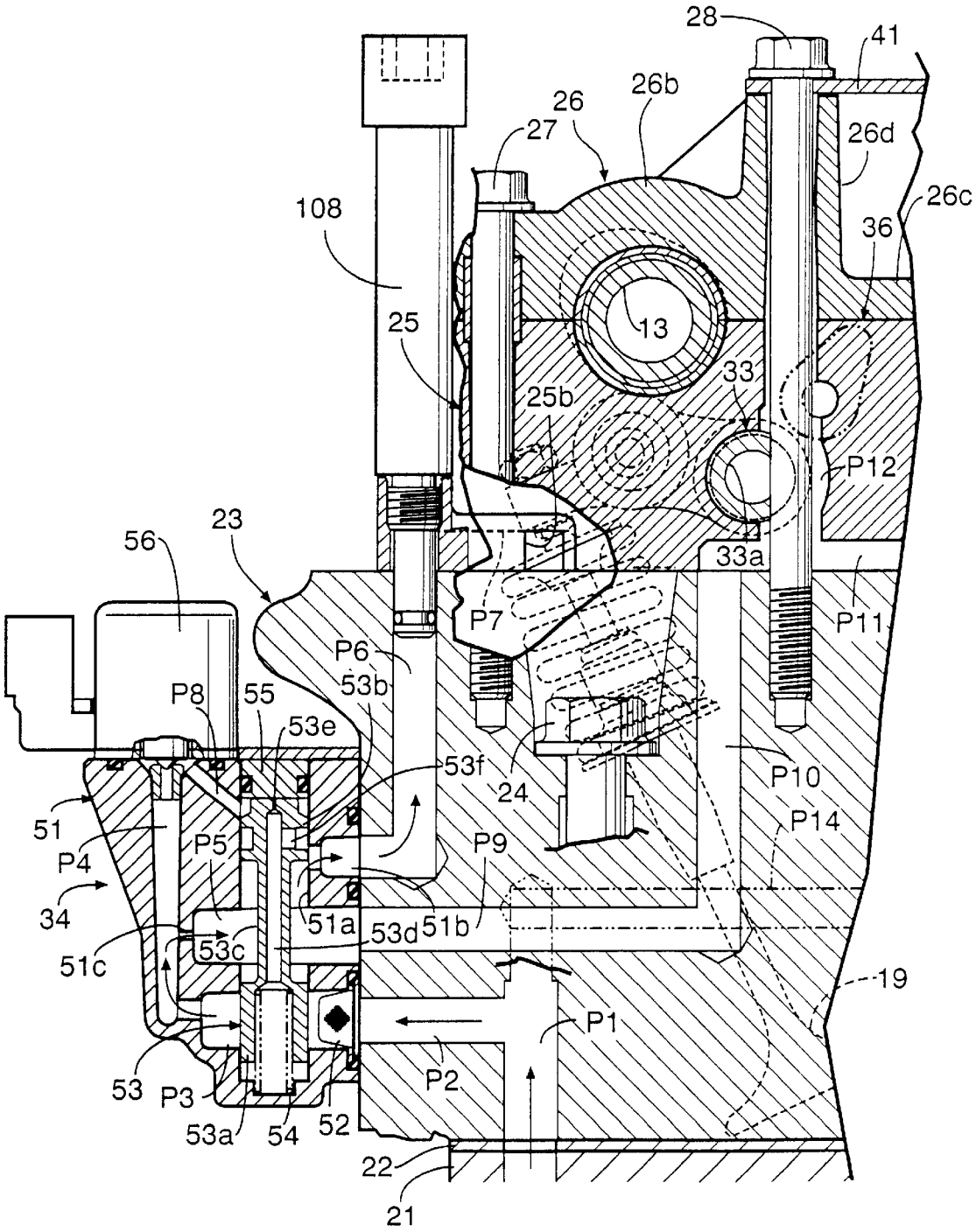

The operating conditions of the first variable valve operating characteristic mechanism V1 can easily be checked by detaching the blind cap 35 provided on the protruding expanded part 25*a* of the lower camshaft holder 25 facing the downstream end of the oil passage P6 of the cylinder head 23, attaching a measurement apparatus 108 instead of the above-mentioned blind cap 35 as shown in FIG. 13 and supplying a fluid pressure of, for example, air from the measurement apparatus 108. As is clear from FIG. 5, since the seat for the blind cap 35 formed in the lower camshaft holder 25 is provided at a lower position than the place where it is joined to the upper camshaft holder, not only can the length of the blind cap 35 be shortened, but also the dimensions of the lower camshaft holder 25 can be reduced.

Merely fitting the extremity of the measurement apparatus 108 in the oil passage P6 within the cylinder head 23 via a sealing member allows the operating conditions of the first variable valve operating characteristic mechanism V1 to be checked without receiving any influence (escape of fluid pressure) from the oil passage P7 for the relief oil.

Figure 14:
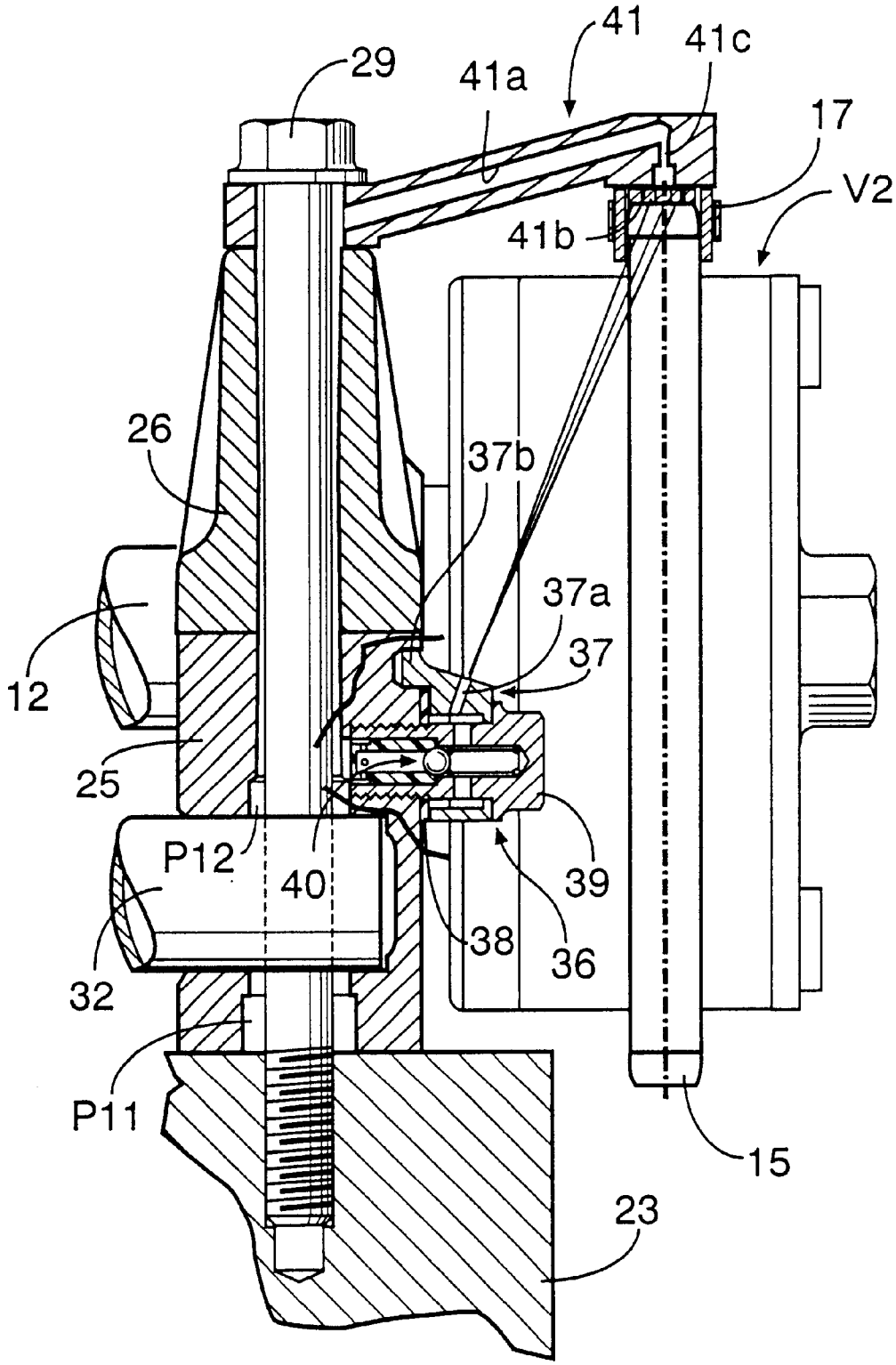
FIG. 14 is a diagram corresponding to FIG. 8 relating to a second embodiment of the present invention.

Next, a second embodiment of the present invention is explained by reference to FIG. 14.

A chain guide 41 of the second embodiment does not have a sliding member 43 made of a synthetic resin; instead, the upstream side of an oil passage 41*a* formed within the chain guide 41 communicates with an oil passage P12 formed on he outer periphery of a bolt 28 and the downstream side of the oil passage 41*a* communicates with an orifice 41*c* opening on a sliding face 41*b* facing a timing chain 17. When an engine E rotates at a high speed, and oil at a high pressure is supplied to the oil passage P12, the oil issues toward the inner periphery of the timing chain 17 from an oil jet 36 as well as toward the outer periphery of the timing chain 17, via the orifice 41*c*, from the oil passage 41*a* formed within the chain guide 41. A sliding section between the sliding face 41*b* of the chain guide 41 and the timing chain 17 can be lubricated effectively with the oil issuing through the orifice 41*c*. It is also possible to make the above-mentioned orifice 41*c* open on tooth skipping prevention plates 42*a* and 42*b* (FIG. 3) of the chain guide 41, and this arrangement allows the sections where the intake camshaft sprocket 15 and the exhaust camshaft sprocket 16 are meshed with the timing chain 17 to be lubricated effectively.

Although embodiments of the present invention have been explained in detail above, the present invention can be modified in a variety of ways without departing from the spirit and scope of the present invention.

For example, the oil drain hole 25*b* can be provided at the downstream end of the oil passage P7 for the relief oil so as to face the timing chain 17 prior to (preferably immediately before) the section where the exhaust camshaft sprocket 16 is meshed with the timing chain 17 as long as the meshed section can be lubricated with the relief oil. In the embodiments, the oil passage P7 is formed in the plane in which the cylinder head 23 and the lower camshaft holder 25 are joined together, but it is also possible to form it in the plane in which the lower camshaft holder 25 and the upper camshaft holder 26 are joined together.

Furthermore, in the invention described in claim 1, the camshaft supported in a cylinder head via a camshaft holder includes an arrangement in which a lower camshaft holder is not provided, that is to say, an arrangement in which a camshaft is supported by a cylinder head and an upper camshaft holder.

What is claimed is:

1. A timing chain lubricating structure for an engine in which a sprocket is fixed to an end of a camshaft supported in a cylinder head via a camshaft holder and a timing chain is wrapped around the sprocket, comprising:

a relief oil passage formed in the plane of a joined surface of the camshaft holder; and an oil drain hole provided at the downstream end of the relief oil passage and opening so as to face the section where the sprocket is meshed with the timing chain or the timing chain prior to the meshed section, wherein the timing chain is wrapped around sprockets that are fixed to ends of an intake camshaft and an exhaust camshaft respectively, a chain guide for guiding the timing chain is fixed to cam caps of the two camshafts, the cam cap of the intake camshaft and the cam cap of the exhaust camshaft are linked integrally to each other via a connecting wall so as to from a camshaft holder, and a recess is formed in the face of the connecting wall opposite the chain guide, and wherein a tooth skipping prevention plate is formed integrally with the chain guide.

2. A timing chain lubricating structure for an engine in which a sprocket is fixed to an end of a camshaft supported in a cylinder head via a camshaft holder and a timing chain is wrapped around the sprocket, comprising:

a relief oil passage formed in the plane of a joined surface of the camshaft holder; and an oil drain hole provided at the downstream end of the relief oil passage and opening so as to face the section where the sprocket is meshed with the timing chain or the timing chain prior to the meshed section, wherein the timing chain is wrapped around sprockets that are fixed to ends of an intake camshaft and an exhaust camshaft respectively, a chain guide for guiding the timing chain is fixed to cam caps of the two camshafts, the cam cap of the intake camshaft and the cam cap of the exhaust camshaft are linked integrally to each other via a connecting wall so as to form a camshaft holder, and a recess is formed in the face of the connecting wall opposite the chain guide, wherein the camshaft holder is fastened to the cylinder head by means of an outer bolt placed outside the intake camshaft and the exhaust camshaft, the camshaft holder and the chain guide are together fastened to the cylinder head by means of an inner bolt placed inside the intake camshaft and the exhaust camshaft, and the seats of the outer bolts are formed so as to be lower than the seats of the inner bolts, and wherein a tooth skipping prevention plate is formed integrally with the chain guide.

3. A timing chain lubricating structure for an engine in which a sprocket is fixed to an end of a camshaft supported in a cylinder head via a camshaft holder and a timing chain is wrapped around the sprocket, comprising:

a relief oil passage formed in the plane of a joined surface of the camshaft holder; and an oil drain hole provided at the downstream end of the relief oil passage and opening so as to face the section where the sprocket is meshed with the timing chain or the timing chain prior to the meshed section, wherein the camshaft holder is fastened by camshaft holder fastening bolts provided on either side of the camshaft axis and one of the camshaft holder fastening bolts that is closer to the relief oil passage is shorter than the outer camshaft holder fastening bolt.

4. A timing chain lubricating structure for an engine in which a sprocket is fixed to an end of a camshaft supported in a cylinder head via a camshaft holder and a timing chain is wrapped around the sprocket, comprising:

a relief oil passage formed in the plane of a joined surface of the camshaft holder; and an oil drain hole provided at the downstream end of the relief oil passage and opening so as to face the section where the sprocket is meshed with the timing chain or the timing chain prior to the meshed section, wherein the timing chain is wrapped around sprockets that are fixed to ends of an intake camshaft and an exhaust camshaft respectively, a chain guide for guiding the timing chain is fixed to cam caps of the two camshafts, the cam cap of the intake camshaft and the cam cap of the exhaust camshaft are linked integrally to each other via a connecting wall so as to form a camshaft holder, and a recess is formed in the face of the connecting wall opposite the chain guide, wherein the camshaft holder is fastened to the cylinder head by means of an outer bolt placed outside the intake camshaft and the exhaust camshaft, the camshaft holder and the chain guide are together fastened to the cylinder head by means of an inner bolt placed inside the intake camshaft and the exhaust camshaft, and the seats of the outer bolts are formed so as to be lower than the seats of the inner bolts, and wherein the relief oil passage is provide closer to an outer bolt than to an inner bolt.

5. A timing chain lubricating structure for an engine in which a sprocket is fixed to an end of a camshaft supported in a cylinder head via a camshaft holder and a timing chain is wrapped around the sprocket, comprising:

a relief oil passage formed in the plane of a joined surface of the camshaft holder; and an oil drain hole provided at the downstream end of the relief oil passage and opening so as to face the section where the sprocket is meshed with the timing chain or the timing chain prior to the meshed section, wherein the camshaft holder comprises an upper camshaft holder and a lower camshaft holder and the oil drain hole is formed in the lower camshaft holder close to the meshed section, wherein a rocker arm shaft provided beneath the camshaft is supported in the lower camshaft holder and the oil drain hole is provided in the plane in which the lower camshaft holder and the cylinder head are joined together, and wherein the oil drain hole and the rocker arm shaft are provided on either side of the camshaft so that the camshaft is interposed therebetween.

6. The timing chain lubricating structure for an engine according to claim 5, wherein the oil drain hole is provided closer to a hydraulic control valve than to the axis of the camshaft that is placed on the hydraulic control valve side.

7. A timing chain lubricating structure for an engine in which a sprocket is fixed to an end of a camshaft supported in a cylinder head via a camshaft holder and a timing chain is wrapped around the sprocket, comprising:

a relief oil passage formed in the plane of a joined surface of the camshaft holder; and an oil drain hole provided in the downstream end of the relief oil passage and opening so as to face the section where the sprocket is meshed with the timing chain or the timing chain prior to the meshed section for lubricating said timing chain with oil without using an oil jet.

8. The timing chain lubricating structure for an engine according to claim 7, wherein the relief oil passage is provided along a camshaft holder fastening bolt for fastening the camshaft holder.

9. The timing chain lubricating structure for an engine according to claim 7, wherein the oil drain hole is provided on the side of the sprocket that is close to a hydraulic control valve that discharges oil to the relief oil passage.

10. The timing chain lubricating structure for an engine according to claim 7, wherein the camshaft holder comprises an upper camshaft holder and a lower camshaft holder and the oil drain hole is formed in the lower camshaft holder close to the meshed section.

11. The timing chain lubricating structure for an engine according to claim 10, wherein a rocker arm shaft provided beneath the camshaft is supported in the lower camshaft holder and the oil drain hole is provided in the plane in which the lower camshaft holder and the cylinder head are joined together.

12. The timing chain lubricating structure for an engine according to claim 7, wherein the relief oil passage is provided between a camshaft holder fastening bolt for fastening the camshaft holder and the sprocket.

13. The timing chain lubricating structure for an engine according to claim 12, wherein the relief oil passage is provided along the camshaft holder fastening bolt.

14. The timing chain lubricating structure for an engine according to claim 7, further comprising:

a hydraulic control valve for discharging oil to the relief oil passage, the hydraulic control valve being mounted on a cylinder head side wall that is close to the oil drain hole.

15. The timing chain lubricating structure for an engine according to claim 14, wherein the timing chain is wrapped around sprockets that are fixed to ends of an intake camshaft and an exhaust camshaft respectively, a chain guide for guiding the timing chain is fixed to cam caps of the two camshafts, the cam cap of the intake camshaft and the cam cap of the exhaust camshaft are linked integrally to each other via a connecting wall so as to form a camshaft holder, and a recess is formed in the face of the connecting wall opposite the chain guide.

16. The timing chain lubricating structure for an engine according to claim 14, wherein the oil drain hole is provided closer to the hydraulic control valve than to the axis of the camshaft that is placed on the hydraulic control valve side.

17. The timing chain lubricating structure for an engine according to claim 7, wherein the timing chain is wrapped around sprockets that are fixed to ends of an intake camshaft and an exhaust camshaft respectively, a chain guide for guiding the timing chain is fixed to cam caps of the two camshafts, the cam cap of the intake camshaft and the cam cap of the exhaust camshaft are linked integrally to each other via a connecting wall so as to from a camshaft holder, and a recess is formed in the face of the connecting wall opposite the chain guide.

18. The timing chain lubricating structure for an engine according to claim 17, where the chain guide has a sliding member made of a resin, the sliding member being in sliding contact with the timing chain.

19. The timing chain lubricating structure for an engine according to claim 17, wherein the camshaft holder is fastened to the cylinder head by means of an outer bolt placed outside the intake camshaft and the exhaust camshaft, the camshaft holder and the chain guide are together fastened to the cylinder head by means of an inner bolt placed inside the intake camshaft and the exhaust camshaft, and the seats of the outer bolts are formed so as to be lower than the seats of the inner bolts.

20. The timing chain lubricating structure for an engine according to claim 19, wherein the chain guide has a sliding member made of a resin, the sliding member being in sliding contact with the timing chain.

* * * * *